US006055888A

United States Patent [19]

Mitchell

[11] Patent Number: 6,055,888

[45] Date of Patent: May 2, 2000

[54] ANALOG POSITION RATCHET MECHANISM

[75] Inventor: M. Todd Mitchell, 1663 N. 560 West, West Bountiful, Utah 84087

[73] Assignee: M. Todd Mitchell, Layton, Utah

[21] Appl. No.: 09/065,806

[22] Filed: Apr. 23, 1998

[51] Int. Cl.[7] ..... B25B 13/00

[52] U.S. Cl. ..... 81/59.1; 81/63.1; 81/59.39

[58] Field of Search ..... 81/59.1; 192/45, 192/44, 38

[56] References Cited

U.S. PATENT DOCUMENTS

| | | | |
|---|---|---|---|
| 2,989,160 | 6/1961 | Woodruff | 192/44 |
| 3,590,667 | 7/1971 | Bergien | 81/59.1 |
| 3,621,739 | 11/1971 | Seablom | 81/59.1 |
| 3,679,031 | 7/1972 | Stephens | 81/59.1 |
| 4,429,598 | 2/1984 | Tucker | 81/59.1 |
| 4,485,700 | 12/1984 | Colvin . | |
| 4,520,697 | 6/1985 | Moetteli . | |
| 4,631,988 | 12/1986 | Colvin . | |
| 4,903,554 | 2/1990 | Colvin . | |
| 4,987,803 | 1/1991 | Chern | 81/59.1 |
| 5,165,509 | 11/1992 | Kanno et al. | 192/44 |
| 5,178,047 | 1/1993 | Arnold et al. . | |
| 5,235,878 | 8/1993 | Young | 192/44 |
| 5,582,080 | 12/1996 | Barmore . | |
| 5,596,913 | 1/1997 | Matsubara et al. | 81/59.1 |
| 5,630,342 | 5/1997 | Owoc . | |
| 5,697,267 | 12/1997 | Tsai | 81/59.1 |
| 5,709,137 | 1/1998 | Blacklock . | |

*Primary Examiner*—David A. Scherbel
*Assistant Examiner*—Lee Wilson
*Attorney, Agent, or Firm*—Thorpe, North & Western, LLP

[57] ABSTRACT

A wrench device with a bearing-type clutch for selectively and reversibly providing a unidirectional rotational force and an opposite unidirectional independent rotation. The wrench device includes one or more bearings disposed in an irregular space between a primary wall of a primary body and a secondary wall of a secondary body. The space has tapering or narrowing sections in which the bearings bind to fixedly engage the primary and secondary bodies as the primary body rotates in a first rotational direction. A pin or toggle dislodges a bearing so that the primary body may rotate freely in a second, opposing rotational direction while another bearing binds the secondary body to the primary body when said primary body is rotated in the first rotational direction. Alternatively, a bearing is selectively positioned in the space to cause the primary and secondary to rotate together or independently depending on the positioning of the bearing and the rotational direction of the primary body.

47 Claims, 13 Drawing Sheets

ANALOG POSITION RATCHET MECHANISM

BACKGROUND OF THE INVENTION

1. The Field of the Invention

The present invention relates generally to a reversible, instant engagement, bearing-type clutch, particularly well suited for use with a wrench.

2. The Background Art

Various types of fasteners are used to attach two or more members together. A bolt and nut combination is one type of well known fastener. The bolt includes a male threaded end configured to engage a female threaded nut.

The driving end of the bolt, or the head, and the nut are provided with bodies of standard size and shape. The most common shape is a hexagon, or six-sided body. Other shapes are available, including a square. The head may also be provided with a hole or bore of standard size and shape. Such shapes include various stars with straight and curved sides and various polygons. In addition, such heads and nuts are provided in English and metric size ranges, such as ⅛ in., 3/16 in., ¼ in., 5/16 in., ⅜ in., etc., or 3 mm, 4 mm, 5 mm, 6 mm, etc.

Special tools are configured to engage and drive either the head of the bolt and/or the nut. For example, a wrench typically has an open-ended jaw and a closed-ended jaw. The ends are sized and configured to mate with the bolt head or nut. Thus, wrenches typically have apertures formed in the ends with various polygonal shapes, or stars with various numbers of points. In addition, the wrenches are usually provided in sets having numerous wrenches each having jaws configured to mate with a particularly sized bolt head or nut. By engaging the bolt head or nut with the appropriate wrench, the bolt or nut may be rotated clockwise or counterclockwise in order to tighten or loosen the fastener, respectively.

One problem with the above described wrenches is that they often must be continually disengaged and re-engaged with the nut or bolt. Often, a fastener is placed adjacent another member or located in a limited space. Because the wrench has an elongated body, it may be turned only a fraction of the necessary rotation before any further rotation is impeded. Thus, the wrench must be disengaged from the head, rotated back to the starting point, re-engaged with the head, rotated until again impeded, and the process repeated until the fastener is either loosened or tightened. In addition, if the head is located where only a small rotation is possible, the wrench must also be turned over after disengaging because the handle extends at an angle from the end of the wrench. Furthermore, if the space is extremely tight, the wrench may be rendered useless because there is insufficient space in which the wrench may turn the head.

A ratchet wrench is very popular and solves many of the above identified problems with the standard wrench. The ratchet wrench has a ratchet mechanism which allows a handle of the wrench to rotate freely in one direction, but engage a driver coupled to a head of the ratchet wrench in the opposite direction. This allows the ratchet wrench to engage a head, and rotate back and forth, tightening or loosening the fastener without having to disengage the wrench from the head. The typical ratchet wrench has an elongated body with a head adapted to receive sockets of various sizes and shapes. Thus, sockets usually are provided in sets with one or more ratchet wrenches. The ratchet wrench typically has a set of teeth formed on a driver portion and a pawl which engage in one direction.

One problem with the ratchet wrench is the finite increments the wrench may be rotated backwards. Conventional ratchet wrenches have a finite number of engagement points and are therefore limited in the degree they may be rotated backwards by the number of the teeth. For example, if there are 60 teeth, the ratchet wrench is limited to 6 degree increments when rotating backwards before another tooth can be engaged. If the head of the bolt is located in a tight space, it may not be possible to rotate the ratchet wrench a full 6 degrees. Thus, the wrench will not be able to rotate back more than the 6 degrees to engage the next tooth, rendering the wrench useless.

Therefore, it would be advantageous to develop a wrench with an infinite number of engagement points, or a wrench that instantly engages despite the amount of backwards rotation. It would also be advantageous to develop such a wrench capable of operation in both directions, or a reversible wrench. It would also be advantageous to develop a reversible clutch capable of instantaneous engagement and with infinite increments in the reverse direction.

OBJECTS AND SUMMARY OF THE INVENTION

It is therefore an object of the present invention to provide a reversible, instant engagement clutch.

It is another object of the present invention to provide such a clutch for a wrench.

It is another object of the present invention to provide a wrench that engages and drives a fastener in a first rotational direction, but disengages and rotates freely in a second rotational direction.

It is another object of the present invention to provide such a wrench that re-engages and drives the fastener in the first rotational direction, regardless of the amount of rotation in the second rotational direction.

The above objects and others not specifically recited are realized in a number of specific illustrative embodiments of a wrench device having a reversible clutch mechanism. The wrench device includes a secondary body rotatably coupled to a primary body. The primary body may be a main body having an elongated body forming a handle to be gripped by a user. The secondary body may be a cam having a drive member formed thereon for engaging and driving a socket or fastener. Thus, the primary and secondary bodies may form a wrench.

A cavity is formed in the primary body which receives the secondary body. The cavity has a cavity wall and the secondary body has a secondary wall generally opposing the cavity wall. A nonuniform space is formed between the cavity and secondary walls having a nonuniform width. The space has at least two narrowing sections narrowing in opposing directions defining forward and reverse narrowing sections.

At least two intercoupled engagement bearings, a forward bearing and a reverse bearing, are disposed in the nonuniform space. The forward bearing is disposed closer to the forward section than the reverse section, while the reverse bearing is disposed closer to the reverse section than the forward section. A spring intercouples the two bearings and operates to bias the bearings towards the respective narrowing sections. The forward bearing binds in the forward section between the cavity and secondary walls as the primary body pivots in a first rotational direction. The reverse bearing binds in the reverse section between the cavity and secondary walls as the primary body pivots in a second rotational direction, opposite the first rotational direction.

A pivot member is pivotally coupled to the primary body. The pivot member has a grip for being grasped by a user to pivot the pivot member. Advantageously, a pin is formed on the pivot member and extends into the cavity between the forward and reverse bearings. Alternatively, two pins are formed on the pivot member and extend into the cavity with one pin on either side of the bearing pair. Furthermore, a plurality of pins extend into an annular cavity having multiple narrowing sections with multiple engagement bearings.

As the pivot member pivots in a first pivot direction, the pin also pivots to contact and dislodge the reverse bearing from the reverse narrowing section to prevent the reverse bearing from binding. As the primary body rotates with respect to the secondary body in the first rotational direction, the forward bearing binds between the walls causing the primary and secondary bodies to engage and rotate in the first rotational direction. As the primary body rotates with respect to the secondary body in the second rotational direction, the spring allows the forward bearing to move back slightly from the forward narrowing section and slide along the walls. Thus, the primary body rotates independently of the secondary body in the second rotational direction.

As the pivot member pivots in a second pivot direction, the pin also pivots to contact and dislodge the forward bearing from the forward narrowing section to prevent the forward bearing from binding. As the primary body rotates with respect to the secondary body in the second rotational direction, the reverse bearing binds between the walls causing the primary and secondary bodies to engage and rotate in the second rotational direction. As the primary body rotates with respect to the secondary body in the first rotational direction, the spring allows the reverse bearing to move back slightly from the reverse narrowing section and slide along the walls. Thus, the primary body rotates independently with respect to the secondary body in the first rotational direction. Therefore, the pivot member allows the user to select the direction in which the primary and secondary bodies rotate together.

The engagement bearings in the narrowing sections of the nonuniform space fixedly engage the primary and secondary bodies in a first fixed relationship with the primary body in a first relative position as the primary body rotates in the first rotational direction. The primary and secondary bodies disengage as the primary body rotates an amount in the second rotational direction. The bearings fixedly re-engage the primary and secondary bodies in a second fixed relationship with the primary body in a second relative position as the primary body again rotates in the first rotational direction. The bearings re-engage the primary and secondary bodies regardless of the amount of rotational movement of the primary body in the second rotational direction. Therefore, the primary and secondary bodies are instantly engaged as the primary body rotates and the primary and secondary bodies rotate independently of the amount of backwards rotation of the primary body.

Alternatively, a toggle may be pivotally disposed in the secondary body for contacting and dislodging the bearings. A cam portion of the pivot member may extend into a hole formed in the secondary body. The toggle is pivotally disposed in a bore formed in the secondary body extending between the hole and the space between the walls. An indentation is formed in the cam portion for receiving an end of the toggle. Thus, as the pivot member pivots in a first pivot direction, the toggle pivots in an opposite toggle direction to dislodge the bearings.

In addition, the toggle may have a pusher member disposed in the space between the walls and a swivel link pivotally disposed in the bore. The pusher member is pivotally coupled to the swivel link. Thus, the toggle has two pivot points.

Alternatively, the pivot member may have a protrusion with a indentation forming a fork-like projection extending radially outwardly from the pivot member and into a second cavity formed in the primary body adjacent the first cavity. A lever switch is pivotally coupled to the primary body and has a proximal end for being engaged by a user and a distal end with a pin extending into the second space and the indentation of the pivot member. Thus, as the lever switch is pivoted in a first switch direction, the pivot member pivots in a first pivot direction opposite the switch direction.

Alternatively, a single bearing may be selectively positioned in one of the narrowing sections of the nonuniform space. A pivot member with a recess formed therein may be pivotally disposed in the primary body. The bearing is received within the recess as the pivot member pivots between the two narrowing sections, but a spring biases the bearing out of the recess and into one of the narrowing sections as the recess is pivoted towards the narrowing section.

The nonuniform space may be formed by a circular cavity wall and a non-circular secondary wall. Alternatively, the cavity wall may be non-circular while the secondary wall is circular. In addition, both the cavity wall and the secondary wall may be non-circular.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION

Figure 1:
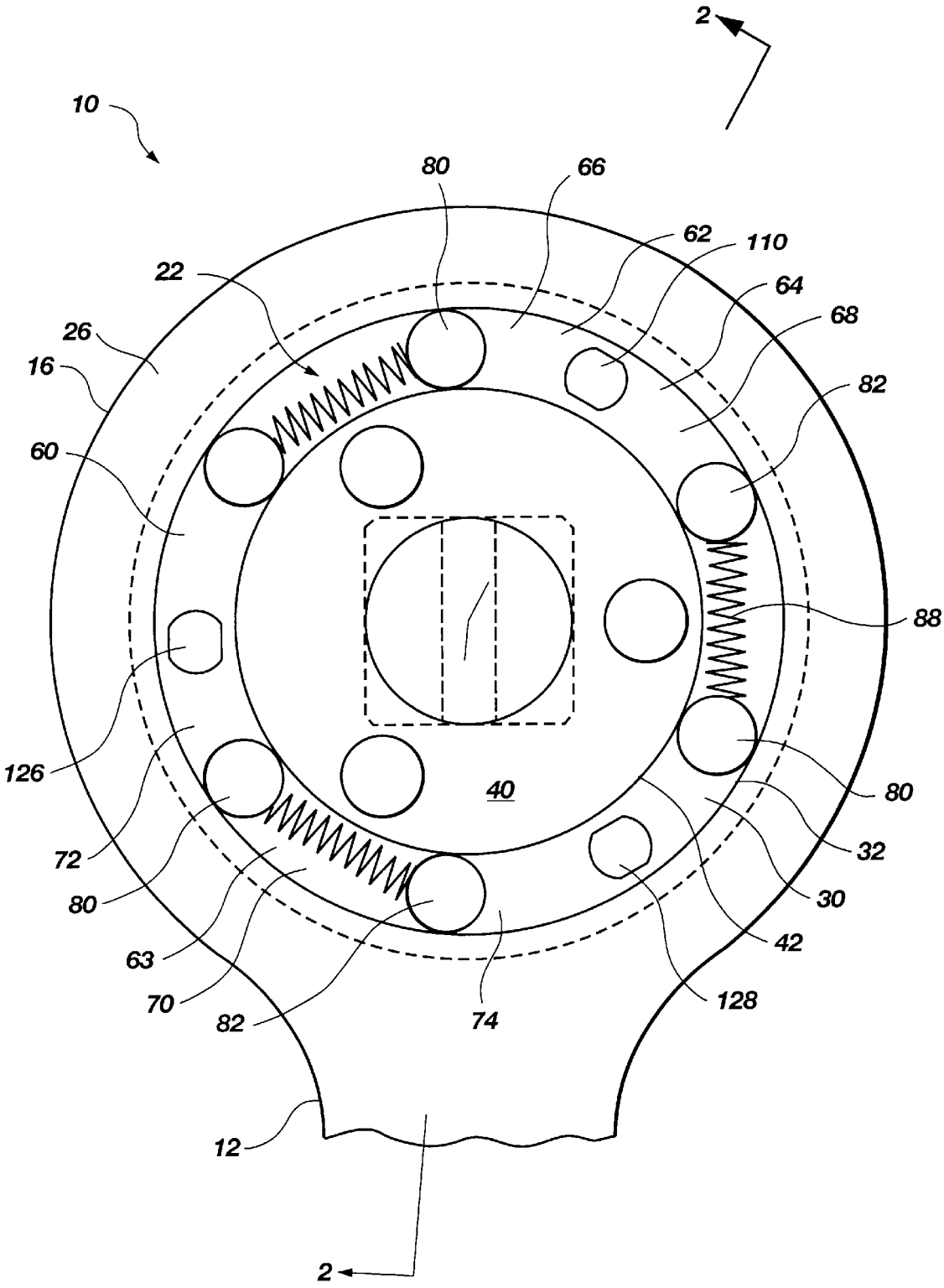
FIG. 1 is a top, break-away view of a wrench device made in accordance with the principles of the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

Figure 2:
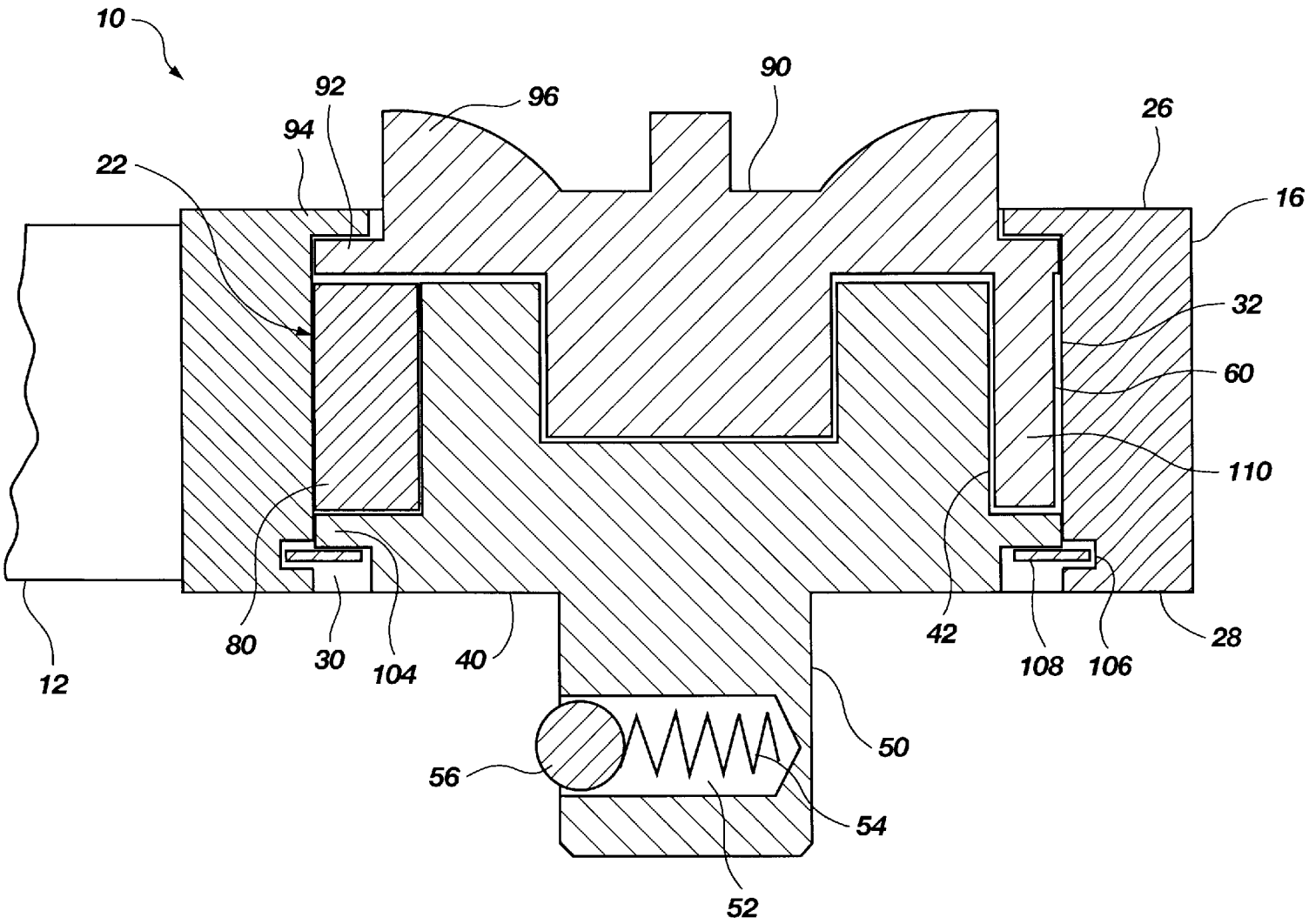
FIG. 2 is a side, cross-sectional view of the wrench device of FIG. 1, taken along section 2—2.
Figure 7:
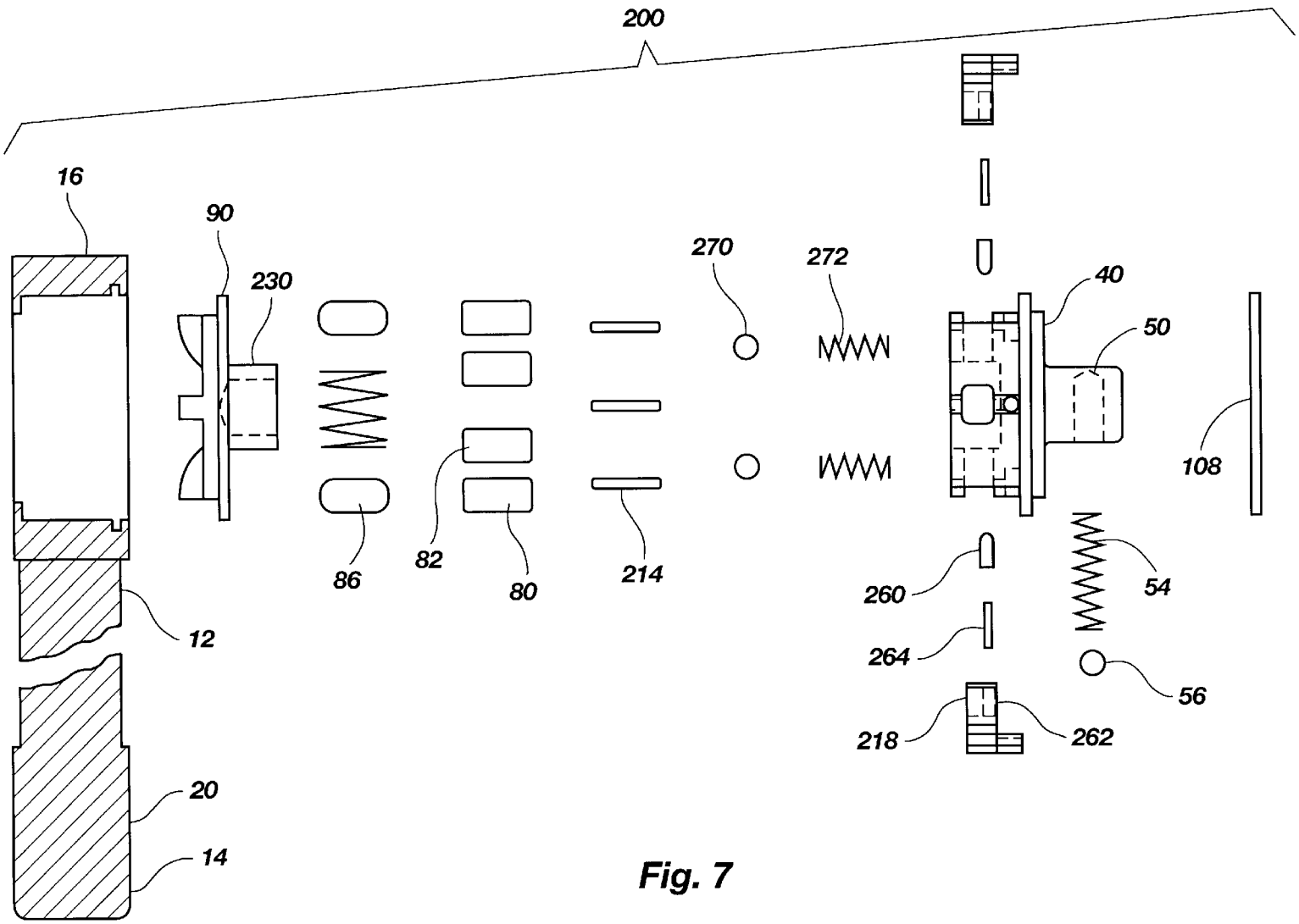
FIG. 7 is an exploded view of the wrench device of FIG. 4.

Referring to FIGS. 1 and 2, a wrench device, indicated generally at 10, of the present invention is shown. The wrench device 10 has an elongated main or primary body 12 with a proximal and a distal end 16, as shown in FIG. 7. A handle 20 is formed on the proximal end 14 of the main body 12 for a user to grasp, again as shown in FIG. 7. The distal end 16 defines a head for engaging and driving a socket or a fastener. Although only the head portion 16 of the wrench device 10 is shown in many of the drawings, the elongated body and handle portion of the wrench device are well known in the art for providing leverage and grip. The wrench device 10 has a reversible, bearing-type clutch, indicated generally at 22, for reversibly and selectively providing a rotational force in one direction and free or independent rotational movement in the other direction.

The wrench device 10 may drive or loosen a fastener (not shown). As used herein, the term "fastener" is used broadly to indicate any type of device for fastening, particularly a type requiring rotational motion to operate. Specifically, the term "fastener" includes at least a bolt or a nut. Typically, nuts and bolts are characterized by hexagonally shaped bodies or heads. Alternatively, other shaped bodies are also included in the term "fastener." In addition, variously shaped indentations or cavities may be formed in the bodies. To accommodate these various types of fasteners, corresponding or mating "sockets" have been developed to engage the fasteners. The term "socket" is also used broadly herein to indicate any device which engages a "fastener." Fasteners and sockets are well known in the art. Thus, the head portion 16 of the wrench device 10 engages and drives the fastener and socket (not shown).

The head 16 or main body 12 has an upper side 26 and a lower side 28, as shown in FIG. 2. A cavity 30 is formed in the head 16 of the main body 12. In addition, the cavity 30 may extend through the head 16 from the upper side 26 to the lower side 28, as shown in FIG. 2. Thus, the cavity 30 is formed traverse to the longitude of the body 12 and the upper and lower sides 26 and 28. The cavity 30 has a cavity wall 32. The cavity wall 32 is preferably formed by the circumference of the cavity 30. The cavity 30 and cavity wall 32 are circular or cylindrical, but may be another shape as discussed more fully below. In addition, the cavity 30 may have sections of various diameters, or annular indentations and annular projections or flanges, as discussed more fully below.

The wrench device 10 also has an engagement cam 40, or secondary body, rotatably coupled to the main body 12. The engagement cam 40 is disposed in the cavity 30 of the main body 12. The cam 40 has a cam wall 42, secondary wall or drive wall. The cam wall 42 and the cavity wall 32 face each other, or are generally opposing one another. The cam 40 and cam wall 42 may be circular or cylindrical, but may be another shape as discussed more fully below. In addition, the cam 30 may have sections of various diameters, or annular indentations and annular projections or flanges, as discussed more fully below.

Referring to FIG. 2, a drive member 50 is disposed on the engagement cam 40 for engaging and driving a socket (not shown). The drive member 50 and engagement cam 40 may be integrally formed. The drive member 50 is sized and configured to engage a cavity of a socket. The drive member 50 may be a protrusion with a standard size and shape configured for engaging a cavity of a standard size and shape in the socket. Thus, the drive member 50 typically will be a protrusion with a square cross section sized for standard socket cavities.

The drive member 50 also has a longitudinal drive cavity 52 for receiving a drive detent ball 56 and drive spring 54, as is well known in the art. As the drive member 50 is inserted into the cavity of the socket, the detent ball 56 is pressed into the drive cavity 52. When the drive member 50 is fully inserted into the cavity of the socket, the spring 54 forces the detent ball 56 to protrude from the drive cavity 52 and into an indentation formed in the cavity of the socket to retain the socket on the drive member 50.

The drive member 50, or the drive member 50 and engagement cam 40, is one example of a driving means for coupling to and driving a fastener or socket. It is of course understood that other drive means for coupling to and driving fasteners and/or sockets are available and include, for example, an integral cam and drive member, a drive member and socket, and integral drive member and socket, etc.

Referring again to FIG. 1, a space 60 is formed between the cam wall 42 and the cavity wall 32, or between the main body 12 and the cam 40 having a nonuniform width. The space 60 advantageously is nonuniform, or uneven, the purpose of which is discusses more fully below. The shape or width of the space 60 is determined by the shape of the cavity 30 and the shape of the cam 40. As indicated above, the cavity wall 32 may be circular while the cam wall 42 is non-circular, thus forming a nonuniform space 60. Alternatively, the cavity wall 32 may be non-circular while the cam wall is circular. In addition, both the cavity wall 32 and the cam wall 42 may be non-circular, or uneven. The variation in the wall 32 and 42 or body 12 and cam 40 shapes is to create a nonuniform space 60 therebetween, or a space 60 with varying distances between the opposing walls 32 and 42, or a space 60 with walls 32 and 42 that taper towards and/or away from one another. The tapering walls create one or more narrowing sections within the space 60. The non-circular walls may be formed of various arcs or straight lines. The nonuniform space 60 is configured and dimensioned to cause the main body to rotate independently with respect to the engagement cam in one rotational direction and to cause the main body and engagement cam to engage and rotate together in another rotational direction, as discussed more fully below.

The space 60 may be annular or ring-like, with one or more narrowing sections. Conceptually, the space 60 may be viewed as being comprised of several, arc-like, component spaces 62 and 63, each having opposing narrowing ends or sections, disposed end-to-end to form a larger annular space. As shown, the space 60 is formed of three, arc-like spaces. The narrowing ends or sections narrow in opposing directions and may narrow towards the component space or away from the component space. The component spaces 62 may have a narrow center section 64 and narrowing ends 66 and 68 that narrow towards the center section 64, or widen away from the center section. The space 62 has a first narrowing section 66 defining a forward end or section and a second narrowing section 68 defining a reverse end or section.

Alternatively, the component spaces 63 may have a wider center section 70 and narrowing ends 72 and 74 that narrow away from the center section 70, or widen towards the center section. The space 63 has a first narrowing section 72 defining a forward end or section and a second narrowing section 74 defining a reverse end or section. It will be appreciated that when the component spaces 62 or 63 are arranged annularly, the component spaces 62 or 63 may be conceptually viewed as either wide spaces with narrow ends or narrow spaces with wide ends, as described above. However, if only a single component space 62 or 63 is used, either type of space 62 or 63 may be used.

At least two engagement bearings 80 and 82, or a pair of bearings, are disposed in the space 60 between the cavity wall 32 and the cam wall 42. The bearings are positioned and dimensioned to bind in the narrowing ends 66 and 68 or 72 and 74 to engage the main body 12 with the engagement cam 40. A first bearing 80 defines a forward bearing and is disposed closer to the first, or forward, narrowing end 66 or 72 than the reverse section. A second bearing 82 defines a reverse bearing and is disposed near the second, or reverse, narrowing end 68 or 74 than the forward end.

Figure 3B:
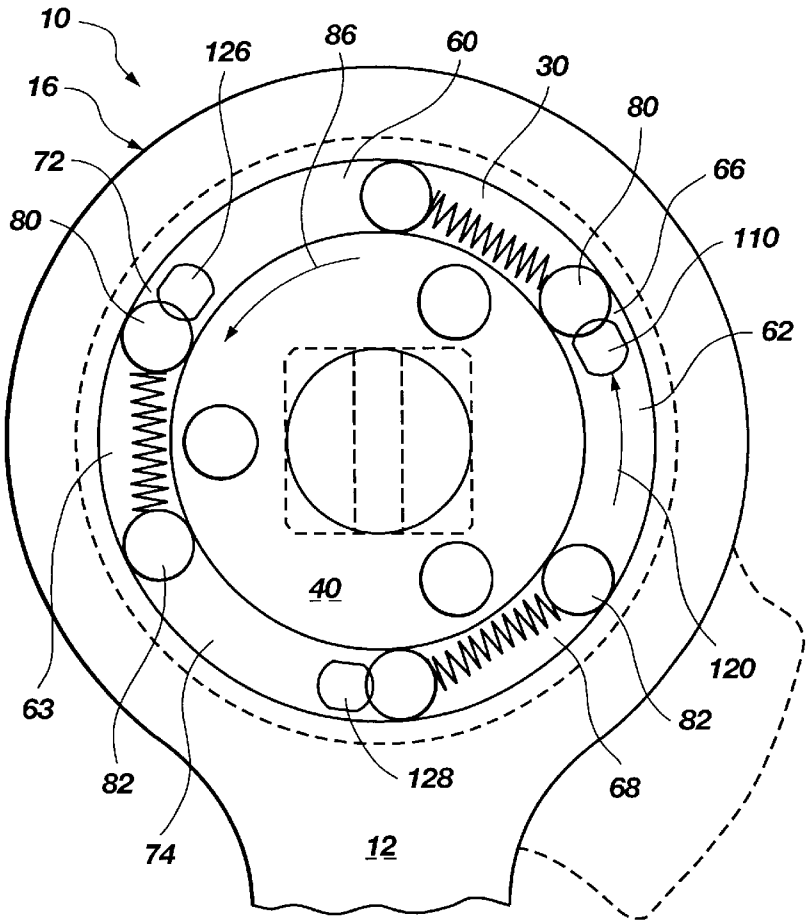
FIG. 3B is a top, break-away view of the wrench device of FIG. 1, in a second position.
Figure 3A:
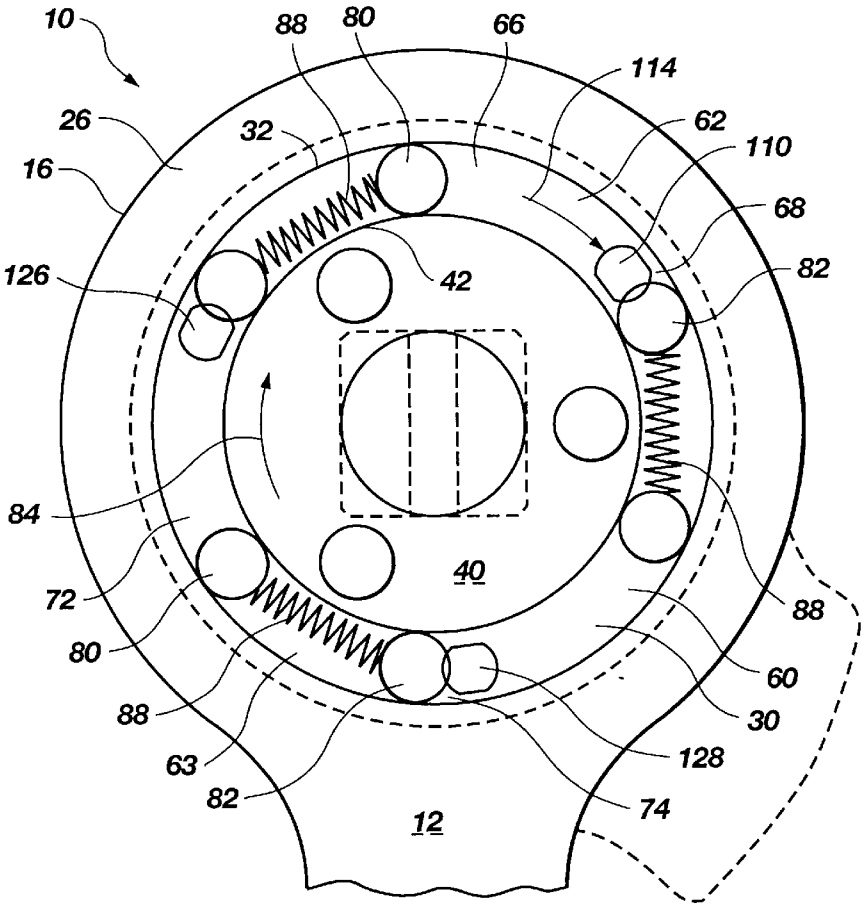
FIG. 3A is a top, break-away view of the wrench device of FIG. 1, in first position.

Referring to FIG. 3A, the forward bearing 80 binds between the cavity wall 32 and the cam wall 42 as the main body 12 rotates with respect to the engagement cam in a first rotational direction, or in a forward rotational direction, indicated by the arrow 83. The forward bearing 80 causes the engagement cam 40, and thus the drive member, to engage and rotate with the main body 12, as indicated by arrow 84.

Referring to FIG. 3B, the reverse bearing 82 binds between the cavity wall 32 and the cam wall 42 as the main body 12 rotates with respect to the engagement cam in a second rotational direction, or in a reverse rotational direction, indicated by the arrow 85. The reverse bearing 82 causes the engagement cam 40, and thus the drive member, to engage and rotate with the main body 12, as indicated by arrow 86.

A spring 88 is disposed in the space 60 for biasing the bearings 80 and 82 towards the narrowing ends or sections 66 and 68 or 72 and 74 of the space 62 or 63. A single spring 88 may be disposed between the bearings 80 and 82 and in the wider center 70 of the space 63. Alternatively, a pair of springs 88 may be disposed on both ends of the bearing pair in the narrow centers 64 of the space 62. The spring is one example of a biasing means for biasing the bearings towards the narrowing ends. It is of course understood that other biasing means are available and include, for example, a rubber member, a pressure differential, etc.

Referring again to FIG. 2, a pivot member 90 is pivotally coupled to the head 16 of the main body 12. Preferably the pivot member 90 is at least partially disposed in the cavity 30. The pivot member 90 has an annular flange 92 that abuts an annular projection 94 formed on the upper side 26 of the head 12 at the cavity 30 for maintaining the pivot member 90 to the head 12. One or more tabs 96 are formed on the pivot member 90 and project therefrom for a user to grip. The tabs are one example of a grip means for being gripped by a user to pivot the pivot member.

An annular flange 104 is disposed on the engagement cam 40. Alternatively, the flange 104 may be a separate component. The flange 104 maintains the bearings 80 and 82 in the cavity 30 of the head 16. An annular indentation 106 is formed in the cavity 30 of the head 16 near the lower side 28. The indentation 106 receives a retaining ring 108 which abuts the flange 104. The retaining ring 108 maintains the cam 40, bearings 80 and 82, pivot member 90, and springs 88 within the cavity.

A pin 110, bar or projection, is formed on the pivot member 90 and extends into the cavity 30 of the main body, or into the space 60 between the cavity and cam walls 32 and 42. Referring again to FIG. 1, the pin 110 projects into the space 62 or 63 between the forward and reverse bearings 80 and 82. The pin 110 contacts or engages the bearings 80 and 82 to displace or dislodge the bearings 80 and 82 from the narrowing ends 66 and 68 or 72 and 74. Thus, the pin 110 prevents one of either the forward or reverse bearings 80 and 82 from binding in the narrowing end between the main body 12 and the cam 40.

Referring again to FIG. 3A, the wrench device 10 of FIG. 1 is shown in a configuration for driving, or tightening, a fastener in the clockwise direction. Typically, a right handed thread is used. It is of course understood that if a left handed thread is used then the rotational directions for tightening and loosening must be reversed. As the pivot member (removed in FIG. 3A) pivots in a first pivot direction, indicated by arrow 114, the pin 110 contacts the reverse bearing 82 and dislodges it, or displaces it, from the reverse end 68 of the space 62. Thus, the reverse bearing 82 is prevented from binding by the pin 110.

As the main body 12 is rotated with respect to the engagement cam in the second rotational direction 85, it rotates independently of the engagement cam 40, or rotates freely. The spring 88 biases the forward bearing 80 into the forward end 66 of the space 62 and into contact with both the cavity and cam walls 32 and 42. But, the spring 88 allows the forward bearing 80 to move back slightly and slide along the cavity and cam walls 32 and 42 as the main body 12 rotates with respect to the engagement cam in the second rotational direction 85.

As the main body 12 is rotated with respect to the engagement cam in the first rotational direction 83, the forward bearing 80 binds in the forward end 66 of the space 62 between cavity and cam walls 32 and 42. Thus, the main body 12 and cam 40 are engaged and rotate together. As shown in FIG. 3A and described above, such a configuration may be used to impart rotational force and motion to drive, or tighten, a fastener.

Referring now to FIG. 3B, the wrench device 10 of FIG. 1 is shown in a configuration for loosening a fastener in the counter-clockwise direction. As the pivot member (removed in FIG. 3B) pivots in a second pivot direction, indicated by arrow 120, the pin 110 contacts the forward bearing 80 and dislodges it, or displaces it, from the forward end 66 of the space 62. Thus, the forward bearing 80 is prevented from binding by the pin 110.

As the main body 12 is rotated with respect to the engagement cam in the first rotational direction 83, it rotates independently of the engagement cam 40, or rotates freely. The spring 88 biases the reverse bearing 82 into the reverse end 68 of the space 62 and into contact with both the cavity and cam walls 32 and 42. But, the spring 88 allows the reverse bearing 82 to move back slightly and slide along the cavity and cam walls 32 and 42 as the main body 12 rotates with respect to the engagement cam in the first rotational direction 83.

As the main body 12 is rotated with respect to the engagement cam in the second rotational direction 85, the reverse bearing 82 binds in the reverse end 68 of the space 62 between cavity and cam walls 32 and 42. Thus, the main body 12 and cam 40 are engaged and rotate together. As shown in FIG. 3B and described above, such a configuration may be used to impart rotational force and motion to loosen a fastener.

The pivot member 90 and pin 110 are an example of one displacement means for selectively displacing or dislodging one of the bearings 80 or 82 from the narrowing sections or ends 66 or 68 to prevent one of the bearings from binding. Other displacement means are available, some of which are described more fully below.

Referring to FIGS. 3A and 3B, a pair of pins 126 and 128 may be formed on the pivot member (removed in FIGS. 3A and 3B) and extend into the cavity 30 of the main body, or into the space 60 between the cavity and cam walls 32 and 42. A first pin 126 defines a forward pin and projects into the space 63 near the forward end 72. A second pin 128 defines a reverse pin and projects into the space 63 near the reverse end 74. The forward pin 126 contacts or engages the forward bearing 80 to displace or dislodge the bearing 80 from the forward narrowing end 72. Likewise, the reverse pin 128 contact the reverse bearing 82 to dislodge the bearing 82 from the reverse narrowing end 74. Thus, the pins 126 and 128 each prevent either the forward or reverse bearings 80 and 82, respectively, from binding in the narrowing ends 72 and 74 between the main body 12 and the cam 40.

Referring to FIG. 3A, as the pivot member (removed in FIG. 3A) pivots in the first pivot direction 114 the reverse pin 128 contacts the reverse bearing 82 and dislodges it, or displaces it, from the reverse end 74 of the space 63. Thus, the reverse bearing 82 is prevented from binding by the pin 128. Referring to FIG. 3B, as the pivot member (removed in FIG. 3B) pivots in the second pivot direction 120, the forward pin 126 contacts the forward bearing 80 and dislodges it, or displaces it, from the forward end 72 of the space 63. Thus, the forward bearing 80 is prevented from binding by the pin 126.

It will be appreciated that the operation of the wrench device 10 is similar whether one pin 110 or two pins 126 and 128, or three or more pins, are used. With one pin 110, the pin 110 is disposed between the bearings 80 and 82 while the springs 88 are disposed on either side of the bearing pair. With two pins, the pins 126 and 128 are disposed on either side of the bearing pair while the spring 88 is disposed between the bearings 80 and 82. If multiple bearing pairs are used, the difference is mostly conceptual. The pins may be conceptualized as operating between a pair of bearings or on either side of a bearing pair.

Advantageously, the wrench device 10 has an annular space 60 formed by three component spaces 62 or 63, as indicated above. In addition, the wrench device 10 has three pairs of forward and reverse bearings 80 and 82, with each pair being disposed in a component space 62 or 63. In addition, the wrench device 10 has three springs 88, with each spring 88 being disposed between a pair of bearings 80 and 82. In addition, the wrench device 10 has three pivot pins which act as both forward and reverse pins. Thus, as the pivot member 90 and pins pivot to displace one of the bearings, additional spring force is applied to the other bearing. Furthermore, the cam 40 and cam wall 42 are non-circular, or non-cylindrical, while the cavity 30 and cavity wall 32 are circular, or cylindrical.

The engagement bearings 80 and 82 selectively binding between the cavity and cam walls 32 and 42 are one example of an engagement means. The forward bearing 80 responds to a first rotational movement 83 of the main body 12, or primary body, to fixedly engage the main body 12 and the engagement cam 40, or the primary and secondary bodies, in a first fixed relationship with the main body 12 in a first relative position, indicated by the position of the body in solid lines. The forward bearing 80 responds to an amount of a second rotational movement 85, to disengage the main body 12 and engagement cam 40.

The forward bearing 80 again responds to a first rotational movement 83 of the main body 12, regardless of the amount of the second rotational movement 85, to fixedly re-engage the main body 12 and the engagement cam 40 in a second relative position with the main body 12 in a second relative position, indicated by the position of the body in dashed lines. The wrench device 10 of the present invention presents a significant improvement over prior art ratchet wrenches which require a discrete or finite amount of reverse rotational movement before re-engaging in a second relative position.

The wrench device 10 of the present invention presents a main body and cam, or primary and secondary bodies, with an infinite number of engagement points. There are an infinite number of engagement points around the circumference of the cavity and cam walls 32 and 42 where the bearings 80 and 82 may bind, and thus, an infinite number of fixed relationships between the main body and the cam.

The wrench device 10 of the present invention presents a main body 12 which instantaneously engages the engagement cam 40 and drive member 50 upon the application of rotational movement in the appropriate direction. As the main body 12 rotates in the forward rotational direction 83 the forward bearing 80 immediately binds between the cavity and cam walls 32 and 42 to immediately engage the main body 12 and cam 40. The reverse bearing 80 likewise immediately binds between the cavity and cam walls 32 and 42 when the main body 12 rotates in the reverse rotational direction 85 to immediately engage the main body 12 and cam 40.

Figure 4:
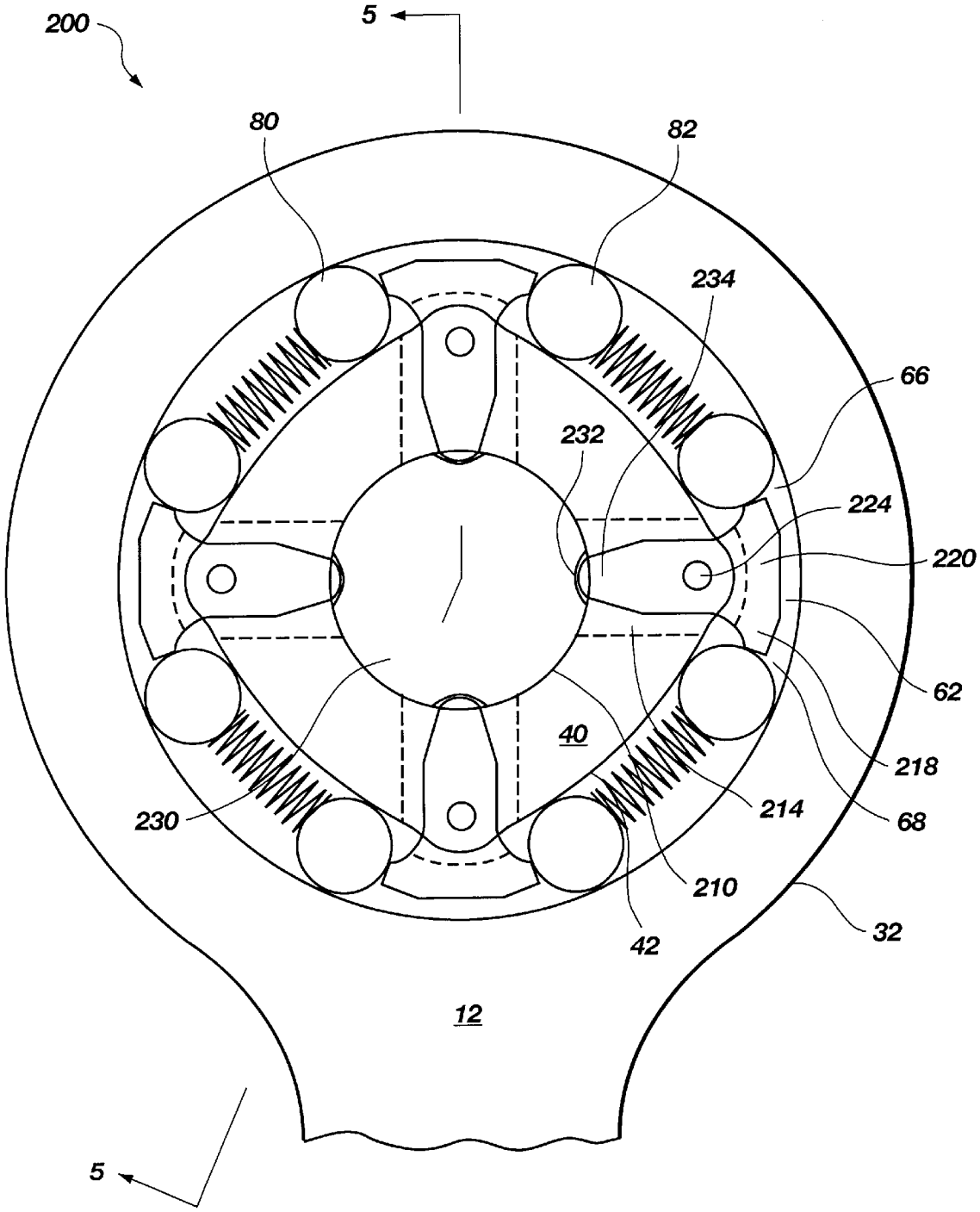
FIG. 4 is top, break-away view of an alternative embodiment of a wrench device in accordance with the principles of the present invention.
Figure 5:
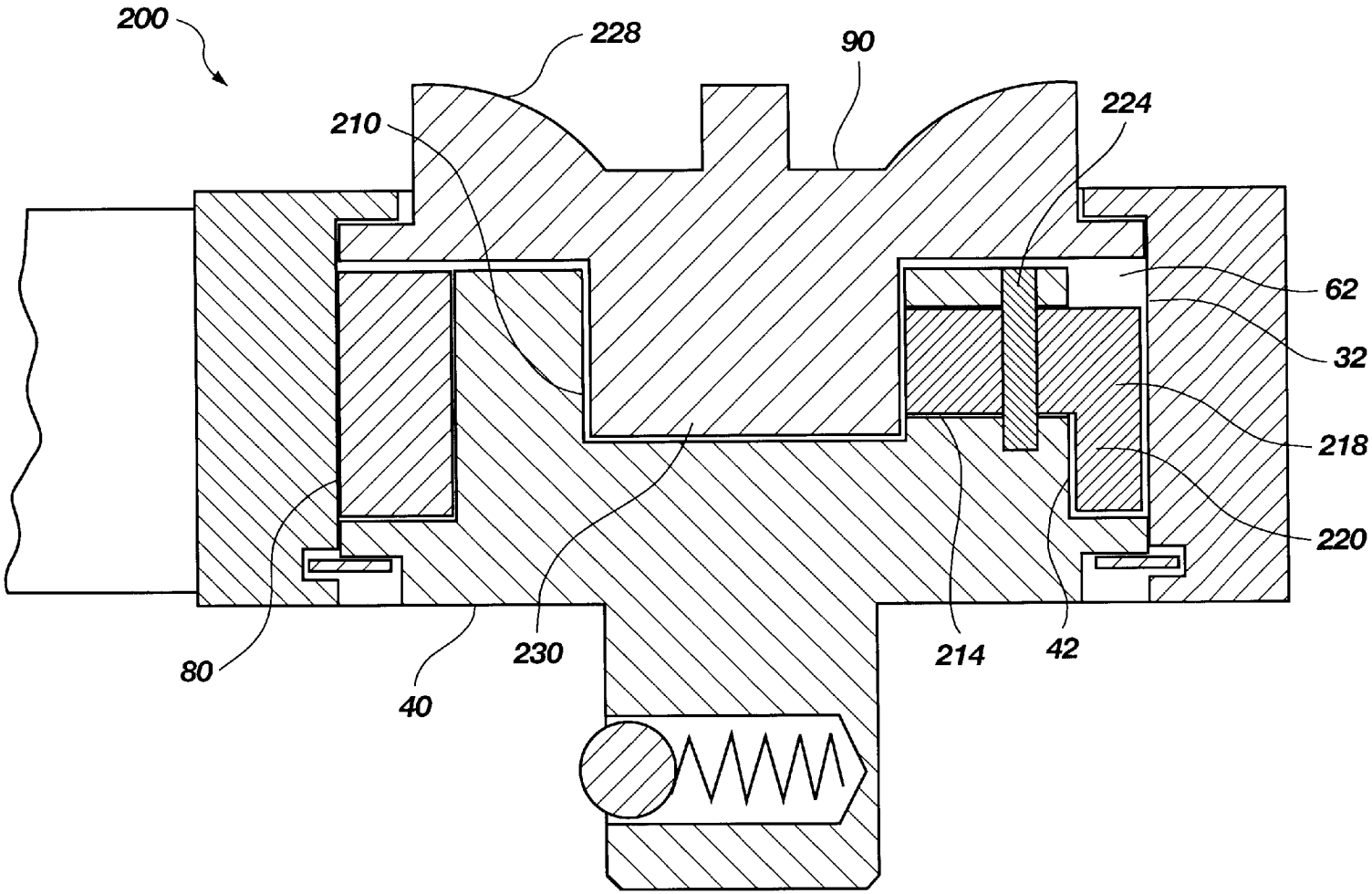
FIG. 5 is a side, cross-sectional view of the wrench device of FIG. 4, taken along section 5—5.

Referring to FIGS. 4 and 5, an alternative embodiment of a wrench device 200 is shown which is similar in many respects to the wrench device 10 of the first embodiment. A longitudinal hole 210 is formed in the engagement cam 40. The longitudinal hole 210 is generally centered in the cam 40.

A radial bore 214 is also formed in the engagement cam 40 and extends radially from the longitudinal hole 210 to the cam wall 42. The bore 214 terminates at the cam wall 42 near the narrow ends 66 and 68 of the space 62, or at the narrower center 64. Four radial bores 214 are formed symmetrically around the cam 40.

A toggle 218 is pivotally disposed in the radial bore 214 for engaging and dislodging the bearings 80 and 82. The toggle 218 has a hammer-shaped head 220 formed on one end. The head 220 is disposed in the space 62 for engaging the bearings 80 and 82. A pivot pin 224 extends through the cam 40, radial bore 214, and toggle 218 about which the toggle pivots. The pin 224 is disposed through the toggle 218 near the head 220 and through the cam 40 near the cam wall 42.

Referring to FIG. 5, the pivot member 90 has a grip portion 228 for being gripped by a user and a cam portion 230. The cam portion 230 of the pivot member 90 extends into, or is received within, the longitudinal hole 210 of the engagement cam 40. Referring to FIG. 4, an indentation 232 is formed in the cam portion 230 for operatively engaging or coupling the pivot member 90 and the toggle 218. The indentation 232 receives an end 234 of the toggle 218 opposite the head 220. Thus, as the pivot member 90 and cam portion 230 pivot, the engagement between the indentation 232 and the end 234 of the toggle 218 causes the toggle 218 to pivot. Alternatively, the indentation may receive a detent ball or pusher formed in the toggle, as discussed more fully below.

Figure 6B:
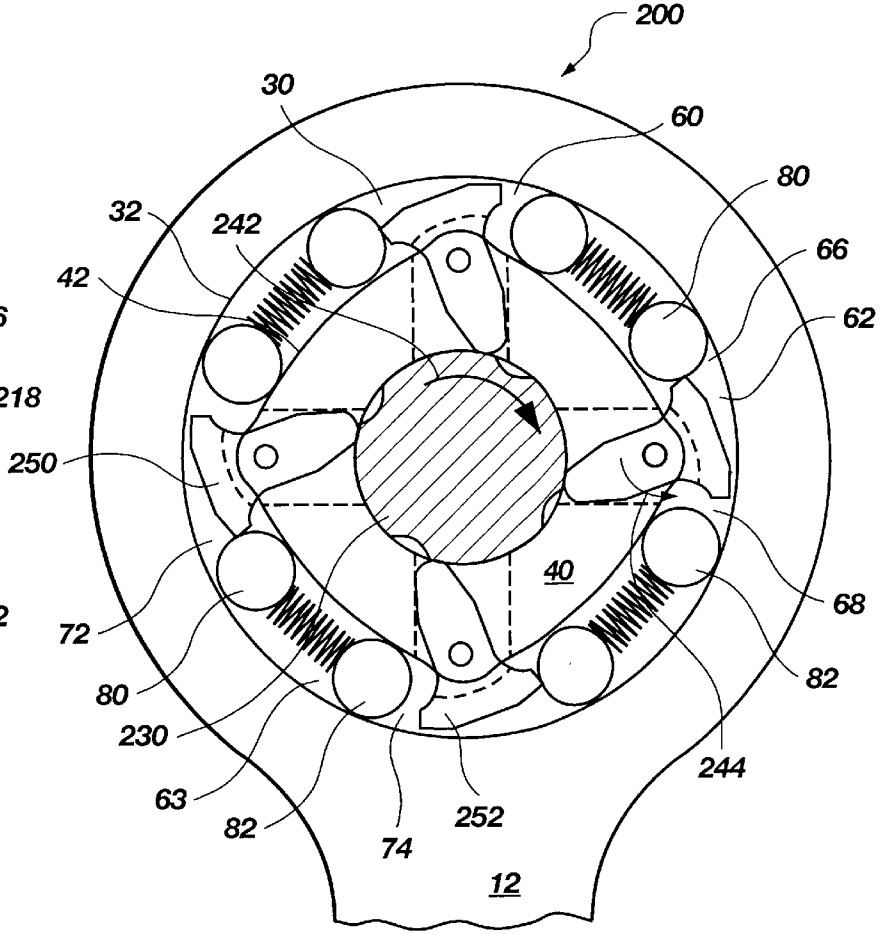
FIG. 6B is top, break-away view of the wrench device of FIG. 4, in a second position.
Figure 6A:
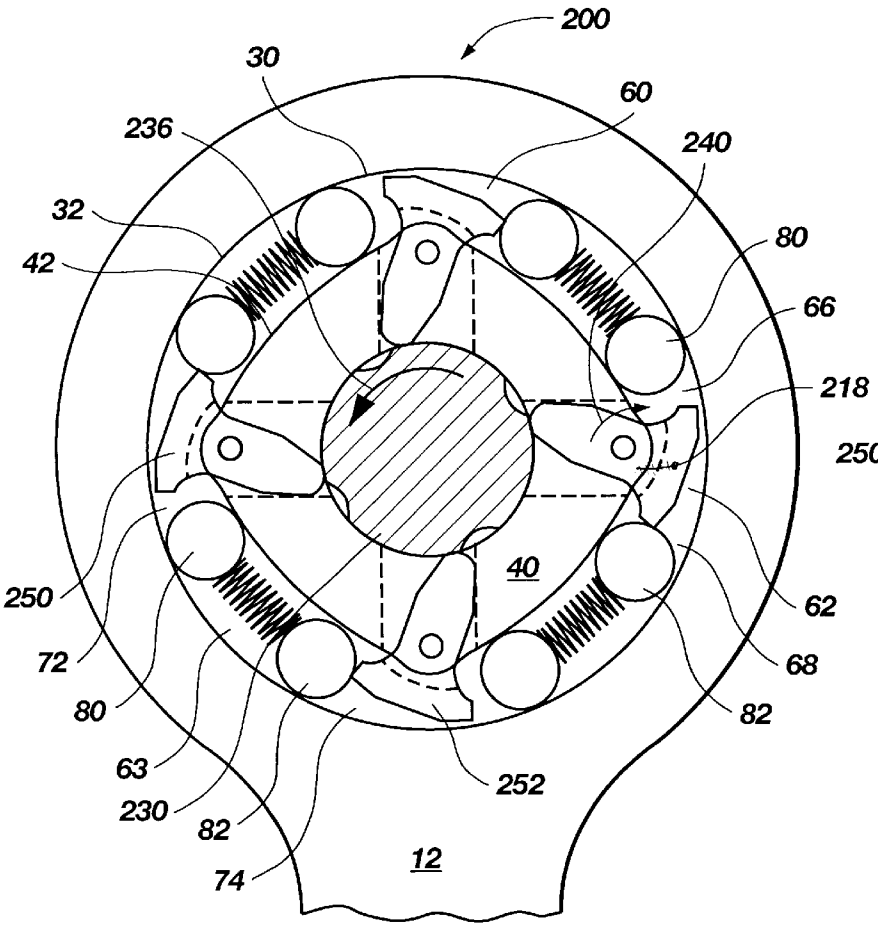
FIG. 6A is a top, break-away view of the wrench device of FIG. 4, in a first position.

Referring now to FIG. 6A, as the pivot member (removed in FIG. 6A), and thus the cam portion 230, is pivoted in a first pivot direction, indicated by arrow 236, the toggle 218 pivots in a first toggle direction, indicated by arrow 240, opposite that of the pivot direction 236. As the toggle 218 pivots in the first toggle direction 240, the head 220 of the toggle contacts and dislodges the reverse bearing 82 from the reverse narrowing end 68 of the space 62. Thus, the reverse bearing 82 is prevented from binding by the toggle 218.

As the main body 12 is rotated with respect to the engagement cam in the second rotational direction 85, it rotates independently of the engagement cam 40, or rotates freely. As the main body 12 is rotated with respect to the engagement cam in the first rotational direction 83, the forward bearing 80 binds in the forward end 66 of the space 62 between cavity and cam walls 32 and 42. Thus, the main body 12 and cam 40 are engaged and rotate together. As shown in FIG. 6A and described above, such a configuration may be used to impart rotational force and motion to drive, or tighten, a fastener.

Referring to FIG. 6B, as the pivot member (removed in FIG. 6B), and thus the cam portion 230, pivots in a second pivot direction, indicated by arrow 242, the toggle 218 pivots in a second toggle direction, indicated by arrow 244, opposite that of the pivot direction 242. As the toggle 218 pivots in the second toggle direction 242, the head 220 of the toggle contacts and dislodges the forward bearing 80 from the forward narrowing end 66 of the space 62. Thus, the forward bearing 80 is prevented from binding by the toggle 218.

As the main body 12 is rotated with respect to the engagement cam in the first rotational direction 83, it rotates independently of the engagement cam 40, or rotates freely. As the main body 12 is rotated with respect to the engagement cam in the second rotational direction 85, the reverse bearing 82 binds in the reverse end 68 of the space 62 between cavity and cam walls 32 and 42. Thus, the main body 12 and cam 40 are engaged and rotate together. As shown in FIG. 6B and described above, such a configuration may be used to impart rotational force and motion to loosen a fastener.

The toggle 218 is an example of another displacement means for selectively displacing one of the bearings 80 or 82 from the narrowing sections or ends 66 or 68 to prevent one of the bearings from binding.

Referring to FIGS. 6A and 6B, a pair of toggles 250 and 252 may be disposed in radial bores 214 and extend into the cavity 30 of the main body, or into the space 60 between the cavity and cam walls 32 and 42. A first toggle 250 defines a forward toggle and projects into the space 63 near the forward end 72. A second toggle 252 defines a reverse toggle and projects into the space 62 near the reverse end 74. The forward toggle 250 contacts or engages the forward bearing 80 to displace or dislodge the bearing 80 from the forward narrowing end 72. Likewise, the reverse toggle 252 contact the reverse bearing 82 to dislodge the bearing 82 form the reverse narrowing end 74. Thus, the toggles 250 and 252 each prevent either the forward or reverse bearings 80 and 82, respectively, from binding in the narrowing ends 72 and 74 between the main body 12 and the cam 40.

Referring to FIG. 6A, as the pivot member (removed in FIG. 3A), and thus the cam portion 230, pivots in the first pivot direction 236 the reverse toggle 252 pivots in the first toggle direction 240 to dislodge the reverse bearing. Referring to FIG. 6B, as the pivot member (removed in FIG. 3B), and thus the cam portion 230, pivots in the second pivot direction 242, the forward toggle 250 pivots in the second toggle direction 244 to dislodge the forward bearing 80.

It will be appreciated that the operation of the wrench device 200 is similar whether one toggle 218 or two toggles 250 and 252 are used. If multiple bearing pairs are used, the difference is mostly conceptual. The toggles may be conceptualized as operating between a pair of bearings or on either side of a bearing pair. Advantageously, the wrench device 200 has four bearing pairs and four toggles 218 disposed symmetrically about the space 60 or cam 40. As shown, each toggle acts as both forward and reverse toggle.

Referring now to FIG. 7, the wrench device 200 is shown in an exploded view to illustrate the various components. Many of the components of the alternative embodiment of the wrench device 200 are similar to the components of the first embodiment of the wrench device 10. The alternative embodiment is shown in greater detail as it is more complicated than the first embodiment, but functions under the same principles and with many similar parts.

The wrench device 200 has a main body 12, or primary body, and an engagement cam 40, or secondary body, with an integral drive member 50. The device 200 also has a pivot member 90 with a cam portion 230. The device 200 has a plurality of springs 86 and bearings 80 and 82. The device 200 also has a plurality of toggles 218 and a plurality of pivot pins 214. The device 200 also has a retaining ring 108.

As indicated above, the toggles 218 may have a detent ball 260, pusher or pin received within a hole 262 in the toggle 218 and biased by a spring 264. The detent ball 260 or pusher would then be received in the indentation 232 of the cam portion 230 of the pivot member 90. In addition, other detent balls 270 or pushers and springs 272 may be received within holes (not shown) in the engagement cam 40 to be received in indentations (not shown) in the pivot member 90 to maintain the relationship between the pivot member 90 and cam 40 until changed by the user.

Figure 8:
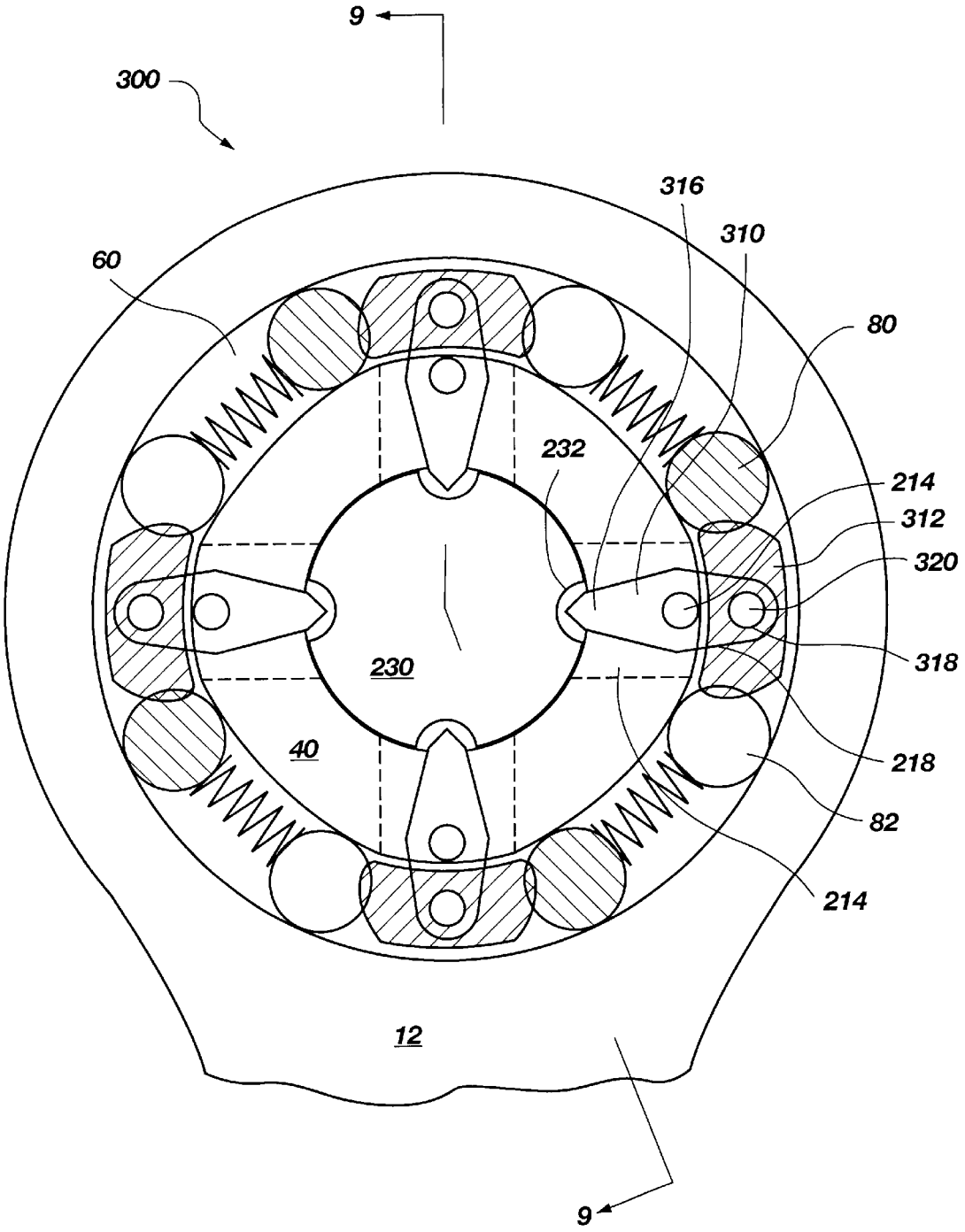
FIG. 8 is a top, break-away view of an alternative embodiment of a wrench device in accordance with the principles of the present invention.
Figure 9:
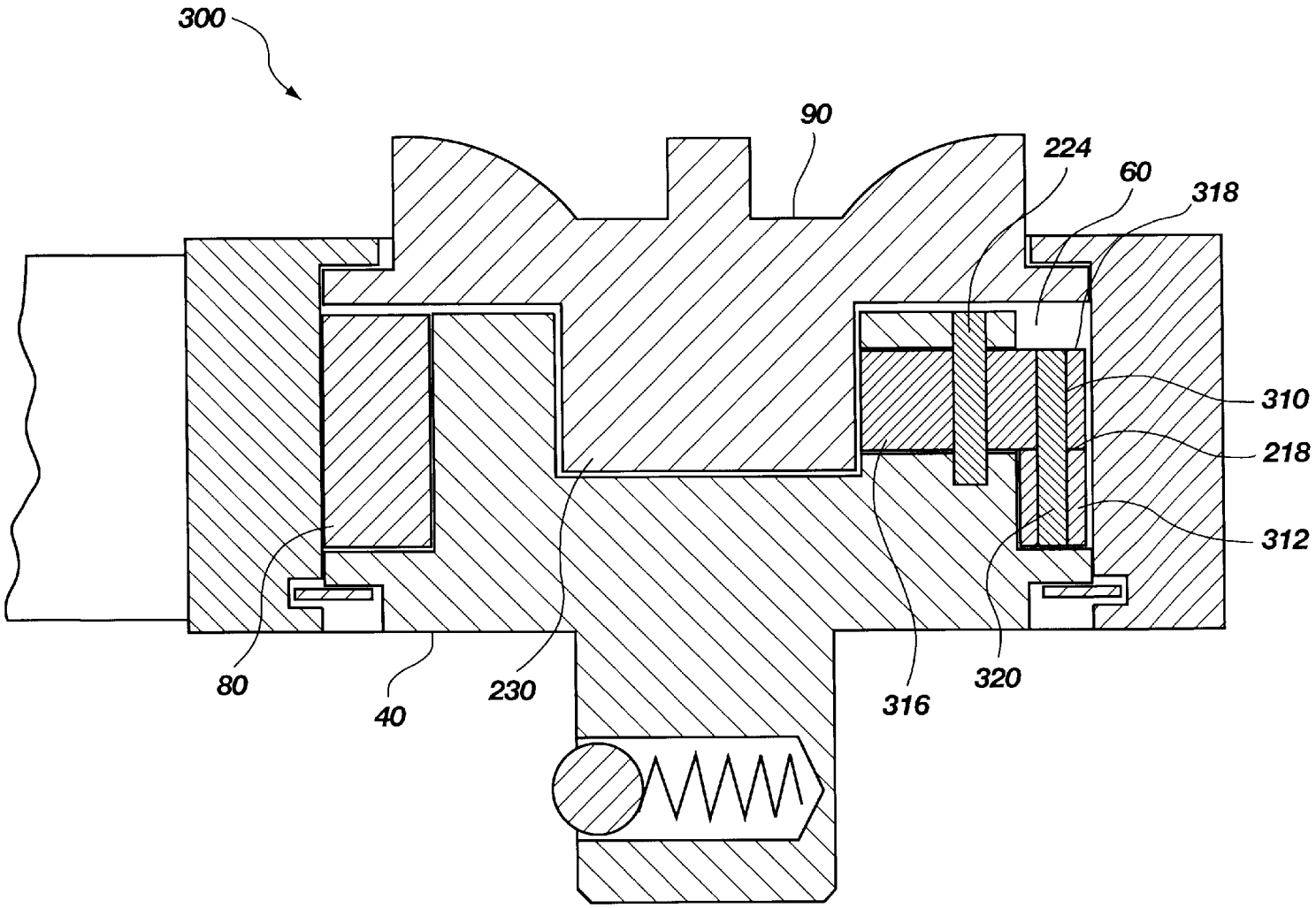
FIG. 9 is a side, cross-sectional view of the wrench device of FIG. 8, taken along section 9—9.

Referring to FIGS. 8 and 9, an alternative embodiment of a wrench device 300 is shown which is similar in many respects to the wrench device 200 of the previous alternative embodiment. The toggle 218 has a swivel link 310 and a pusher member 312.

The swivel link 310 is pivotally disposed in the radial bore 214 of the engagement cam 40. The swivel link 310 has a proximal end 316 and a distal end 318. The proximal end 316 of the swivel link 310 engages the indentation 232 of the cam portion 230 of the pivot member 90.

The pusher member 312 is pivotally disposed on the distal end 318 of the swivel link 310. A second pivot pin 320 is disposed in a hole formed in the swivel link 310 and a hole formed in the pusher member 312 about which the pusher member pivots. The pusher member 312 is movably disposed in the space formed between the main body 12 and the cam 40. The pusher member 312 engages and dislodges the engagement bearings 80 and 82.

Therefore, the toggle 218 of the wrench device 300 has two pivot points, the first pivot pin 214 and the second pivot pin 320. Having two pivot points allows the use of smaller bearings 80 and 82 in a smaller space 60. Whereas the toggle 218 of the previous alternative embodiment of the wrench device 200 pivoted about a single pivot point 214, a larger space 60 was required to accommodate the pivoting motion of the head portion 220 of the toggle 218 within the space 60. In the present alternative embodiment of the wrench device 300, the second pivot point 320 allows the pusher member 312 to move within the space in a sliding motion. Thus, no addition space is required with the space 60 for the pusher member 312 to pivot.

Figure 10B:
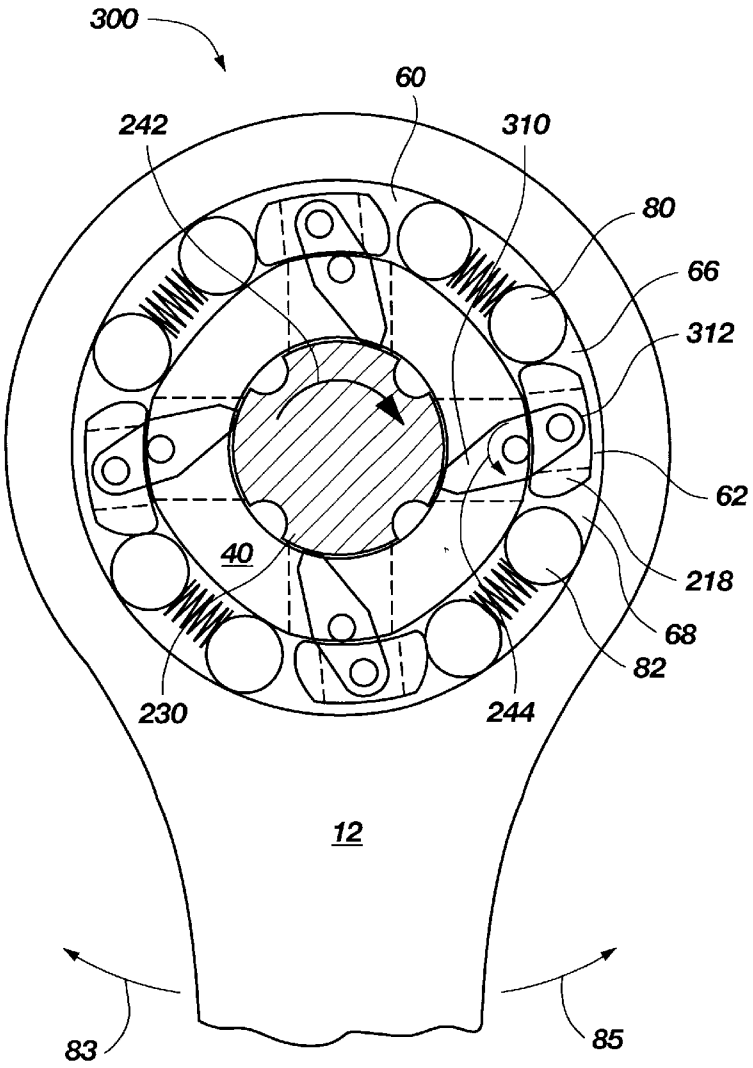
FIG. 10B is a top, break-away view of the wrench device of FIG. 8, in a second position.
Figure 10A:
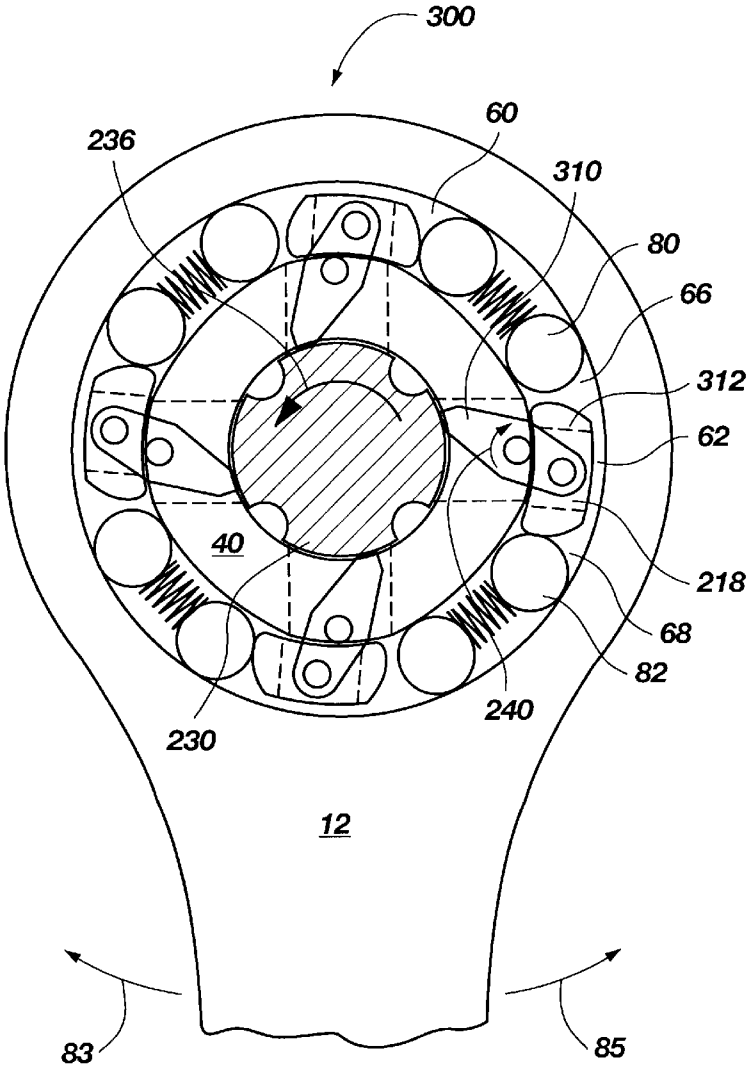
FIG. 10A is a top, break-away view of the wrench device of FIG. 8, in a first position.

Referring to FIG. 10A, as the pivot member (removed in FIG. 6A), and thus the cam portion 230, is pivoted in a first pivot direction, indicated by arrow 236, the swivel link 310 pivots in a first toggle direction, indicated by arrow 240, opposite that of the pivot direction 236. As the swivel link 310 pivots in the first toggle direction 240, the pusher member 312 of the toggle 218 slides in the space 60 and dislodges the reverse bearing 82 from the reverse narrowing end 68 of the space 62. As the main body 12 is rotated in the second rotational direction 85, it rotates independently of the engagement cam 40, or rotates freely. As the main body 12 is rotated in the first rotational direction 83, the forward bearing 80 binds in the forward end 66 of the space 62 between cavity and cam walls 32 and 42.

Referring to FIG. 10B, as the pivot member (removed in FIG. 6B), and thus the cam portion 230, pivots in a second pivot direction, indicated by arrow 242, the swivel link 310 pivots in a second toggle direction, indicated by arrow 244, opposite that of the pivot direction 242. As the toggle 218 pivots in the second toggle direction 244, the pusher member 312 of the toggle 218 slides in the space 60 and dislodges the forward bearing 80 from the forward narrowing end 66 of the space 62. As the main body 12 is rotated in the first rotational direction 83, it rotates independently of the engagement cam 40, or rotates freely. As the main body 12 is rotated in the second rotational direction 85, the reverse bearing 82 binds in the reverse end 68 of the space 62 between cavity and cam walls 32 and 42.

The swivel link 310 and pusher member 312 pivoting about two pivot axes is an example of another displacement means for selectively displacing one of the bearings 80 or 82 from the narrowing sections or ends 66 or 68 to prevent one of the bearings from binding.

Figure 11:
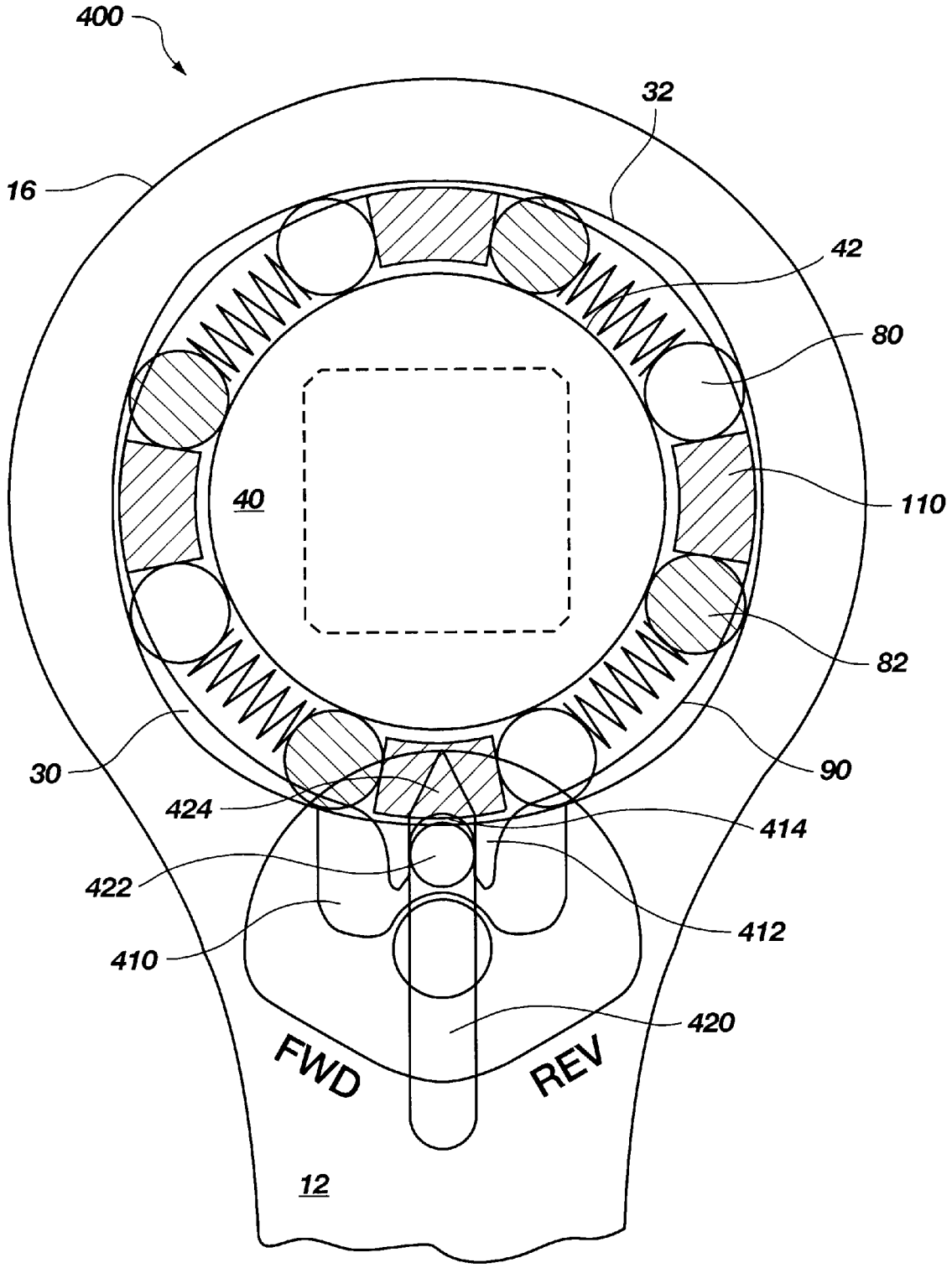
FIG. 11 is a top, break-away view of an alternative embodiment of a wrench device in accordance with the principles of the present invention.

Referring to FIG. 11, an alternative embodiment of a wrench device 400 is shown which is similar in many respects to the wrench device 10 of the first embodiment. A second cavity 410, or pocket, is formed in the main body 12 adjacent the first cavity 30. Thus, the second cavity 410 is an indentation formed in the first cavity 30.

The pivot member 90 has a protrusion 412 formed thereon and extending radially outwardly from the pivot member 90 and into the second cavity 410. An indentation 414 is formed in the protrusion 412. Thus, the protrusion 412 and indentation 414 form a fork-like projection received within the second cavity 410.

A lever switch 420 is pivotally coupled to the head 16 of the main body 12 near the second cavity 410. The lever switch 420 is disposed on the main body 12 such that a user may conveniently engage and pivot the lever switch 420 while grasping the main body 12. A pin 422 is formed on a distal end 424 of the lever switch 420. The pin 422 extends into the second cavity 410 and is movably disposed in the indentation 414 of the pivot member 90.

Figure 12B:
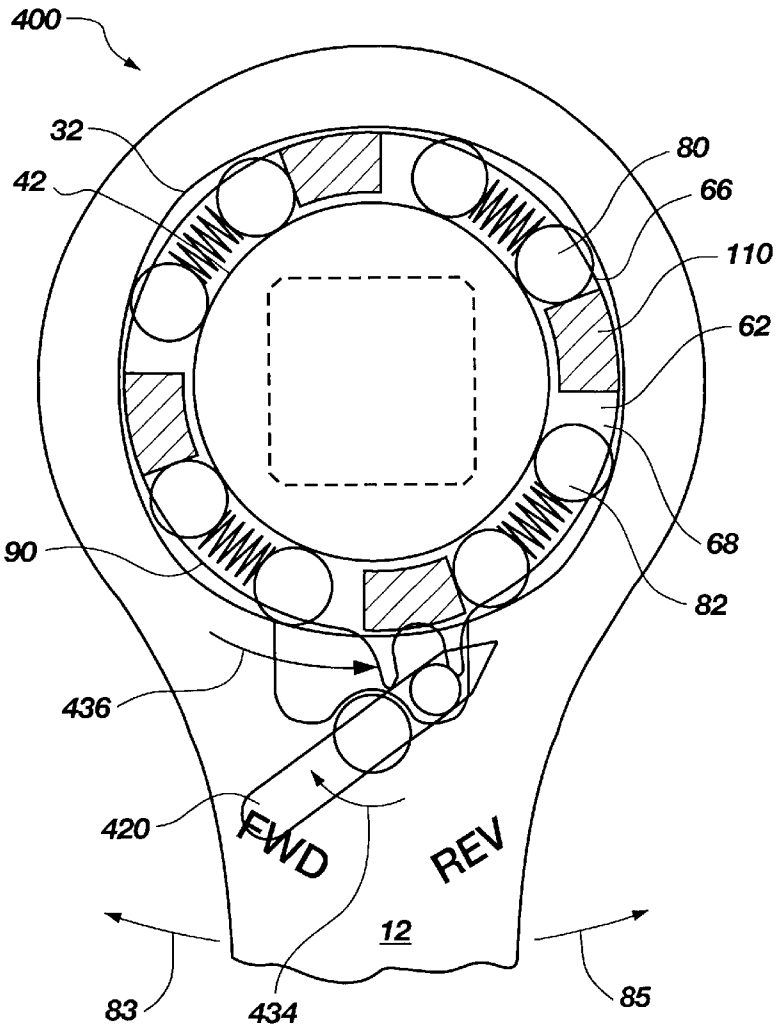
FIG. 12B is a top, break-away view of the wrench device of FIG. 11, in a second position.
Figure 12A:
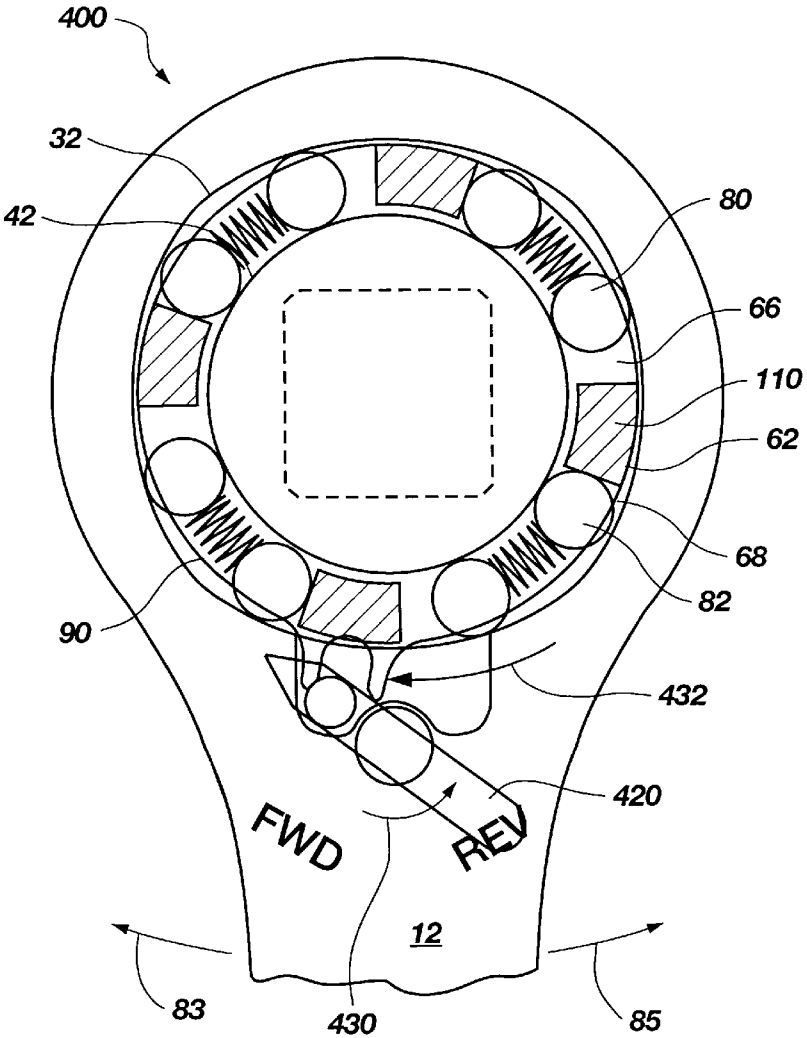
FIG. 12A is a top, break-away view of the wrench device of FIG. 11, in a first position.

Referring to FIG. 12A, as the lever switch 420 is pivoted in a first switch direction, indicated by arrow 430, the pivot member pivots in a first pivot direction, indicated by arrow 432, opposite that of the switch direction 430. As the pivot member 90 pivots in the first pivot direction 432, the bar 110 contacts and dislodges the reverse bearing 82 from the reverse narrowing end 68. As the main body 12 is rotated in the second rotational direction 85, it rotates independently of the engagement cam 40, or rotates freely. As the main body 12 is rotated in the first rotational direction 83, the forward bearing 80 binds in the forward end 66 of the space 62 between cavity and cam walls 32 and 42.

Referring to FIG. 12B, as the lever switch 430 pivots in a second switch direction, indicated by arrow 434, the pivot member 90 pivots in a second pivot direction, indicated by arrow 436, opposite that of the switch direction 434. As the pivot member 90 pivots in the second pivot direction 436, the pin 110 contacts and dislodges the forward bearing 80 from the forward narrowing end 66 of the space 62. As the main body 12 is rotated in the first rotational direction 83, it rotates independently of the engagement cam 40, or rotates freely. As the main body 12 is rotated in the second rotational direction 85, the reverse bearing 82 binds in the reverse end 68 of the space 62 between cavity and cam walls 32 and 42.

The lever switch 420 engaging the protrusion 412 of the pivot member 90 with a pin 110 is an example of another displacement means for selectively displacing one of the bearings 80 or 82 from the narrowing sections or ends 66 or 68 to prevent one of the bearings from binding.

Referring again to FIG. 11, in this embodiment of the wrench device 400, the cam wall 42 is circular while the cavity wall 32 is non-circular.

Figure 13:
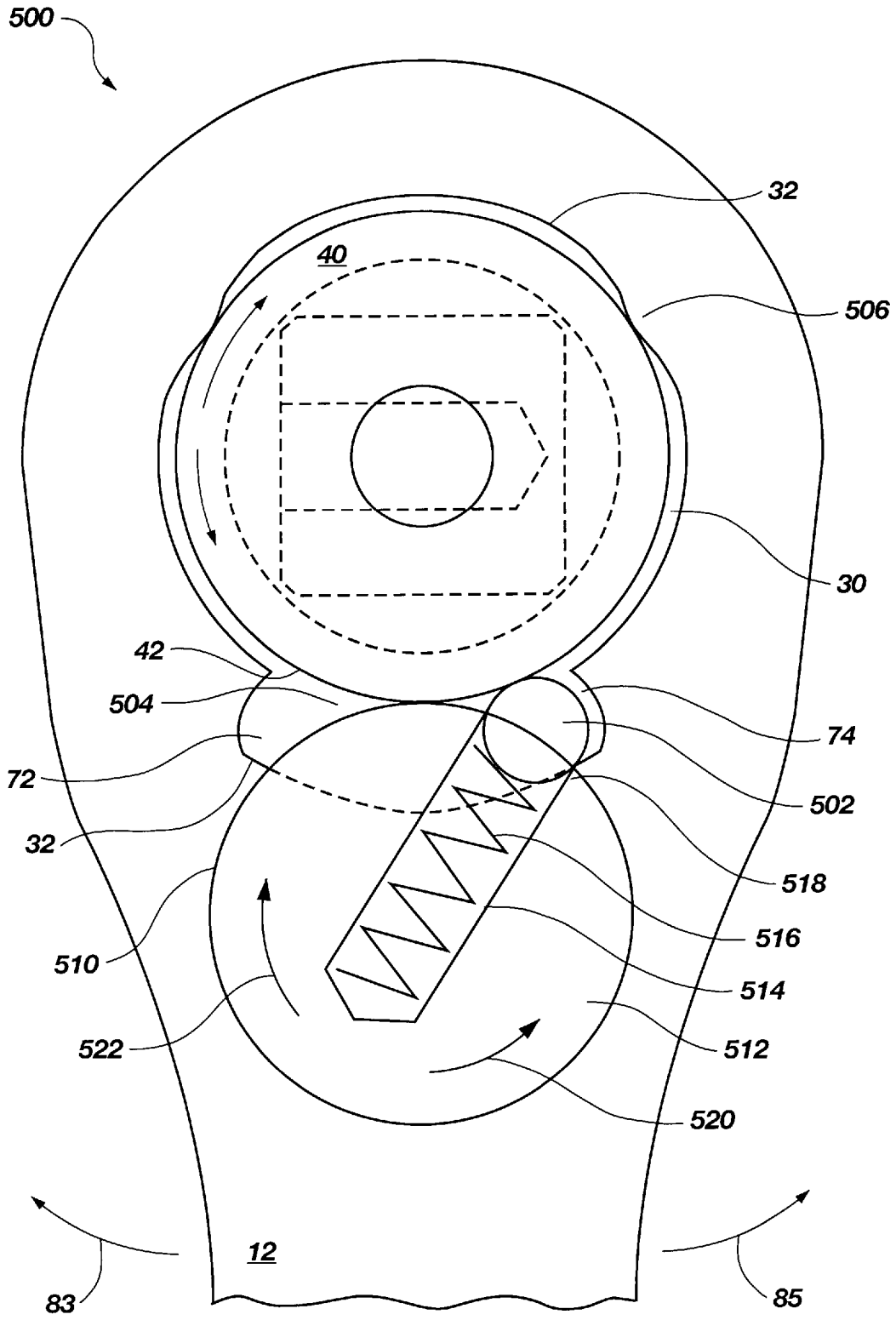
FIG. 13 is a top, break-away view of an alternative embodiment of a wrench device in accordance with the principles of the present invention.

Referring now to FIG. 13, an alternative embodiment of a wrench device 500 is shown which is similar in many respects to the wrench device 10 of the first embodiment, but utilizes a single engagement bearing 502 and a single space 504. The space 504 has a first, or forward, narrowing section 72 and a second, or reverse, narrowing section 74. In addition, a plurality of protrusions 506 are formed on the cavity wall 32 against which the engagement cam 40 slides or binds.

A second cavity 510, or pocket, is formed in the main body 12 adjacent the first cavity 30. Thus, the second cavity 510 is an indentation formed in the first cavity 30. The second cavity 510 may be cylindrically shaped, as shown, and intersect or overlap the primary cavity 30.

A pivot member 512 is disposed in the second cavity 510 and is pivotally coupled to the main body 12. A recess 514 is formed in the pivot member 512 and extends radially therefrom to the space 504. A tab (not shown) or other gripping means may be formed on the pivot member for a user to grasp and pivot the pivot member. The pivot member 512 may be disposed on the main body 12 such that a user may conveniently engage and pivot the pivot member 512 while grasping the main body 12. The pivot member 512 may be cylindrically shaped, as shown.

The bearing 502 is partially disposed within the recess 514 of the pivot member 512. The bearing 502 is biased out of the recess 514 by a spring 516. As the pivot member 512 pivots, an end 518 of the recess 514 is rotated towards the engagement cam 40, forcing the bearing 502 into the recess. As the pivot member 512 is pivoted towards the narrowing sections 72 and 74, the bearing 502 is forced partially out of the recess 514 and into one of the narrowing sections 72 or 74. In addition, the spring 516 forces the bearing 502 into contact with the cam wall 42 and cavity wall 32 which causes the bearing to bind, engaging the main body 12 and engagement cam 40.

As the pivot member 512 pivots in a first pivot direction, indicated by arrow 520, the bearing 502 is positioned in the first, or forward, narrowing section 72. As the main body 12 is rotated in the first rotational direction 83, the bearing 502 binds in the forward section 72 of the space 504 between cavity and cam walls 32 and 42. As the main body 12 is rotated in the second rotational direction 85, it rotates independently of the engagement cam 40, or rotates freely.

As shown in FIG. 13, as the pivot member 512 is pivoted in a second pivot direction, indicated by arrow 522, the bearing 502 is positioned in the second, or reverse, narrowing section 74. As the main body 12 is rotated in the second rotational direction 85, the bearing 502 binds in the reverse section 74 of the space 504 between cavity and cam walls 32 and 42. As the main body 12 is rotated in the first rotational direction 83, it rotates independently of the engagement cam 40, or rotates freely.

The spring 516 biases the bearing 502 into the reverse section 74 of the space 504 and into contact with both the cavity and cam walls 32 and 42. But, the spring 516 allows the bearing 502 to move back slightly and slide along the cavity and cam walls 32 and 42 as the main body 12 rotates with respect to the engagement cam in the first rotational direction 83.

The pivot member 512 with a recess 514 is an example of a positioning means for selectively positioning the bearing in one of the narrowing sections. In this embodiment of the wrench device 500, the cam wall 42 is circular while the cavity wall 32 is non-circular.

Although the engagement bearings in the various embodiments have been shown as cylindrical-type bearings, it is of course understood that any type or bearing may be used. For example, the engagement bearings may be ball bearings, barrel bearings, pin bearings, roller bearings, etc. The engagement bearings may be of any appropriate length or diameter.

In addition, although the present invention has been illustrated and described with particular reference to a wrench device, it is of course understood that the present invention may be applied to any primary and secondary bodies for reversibly and selectively engaging the bodies. For example, a screwdriver device, fishing reel, bike, etc. may also use the principals of the present invention.

It will be appreciated that the structures and apparatus disclosed herein are merely exemplary of engagement means for engaging the main body and cam, and displacement means for dislodging the bearings, and it should be appreciated that any structure, apparatus or system for engaging and/or displacing which performs functions the same as, or equivalent to, those disclosed herein are intended to fall within the scope of a means for engaging and a means for displacing, including those structures, apparatus or systems for engaging and/or displacing which are presently known, or which may become available in the future. Anything which functions the same as, or equivalently to, a means for engaging or means for displacing falls within the scope of this element.

In accordance with the features and combinations described above, a method of driving and/or removing a fastener using the wrench device described above includes coupling an appropriately sized socket to the drive member of the device and the fastener. The socket has a first cavity sized and configured for engaging a fastener and a second cavity sized and configured for receiving the drive member.

To drive, or tighten, the fastener, the pivot member or lever switch is pivoted in a first pivot direction, which may be clockwise or counter clockwise depending on the pivot member or lever switch used. Pivoting the pivot member causes the pins or toggles to contact and dislodge the reverse bearings from the reverse sections of the nonuniform space.

The main body is then rotated in a first rotational direction, or clockwise. As the main body is rotated in the first rotational direction, the forward bearings bind in the forward sections of the nonuniform space between the cavity and cam walls. The forward bearings bind instantly as the main body rotates. As the forward bearings bind, the main body and cam fixedly engage in a first fixed relationship with the main body in a first relative position with respect to the cam. As the main body and cam rotate together in the first rotational direction, the fastener is tightened.

As the main body is rotated in the second rotational direction, the forward bearings move back slightly from the forward sections of the space and slide along the walls. The main body and cam disengage instantly as the main body rotates. Only a small amount of rotational movement in the second rotational direction is required for the main body and cam to disengage. As the main body rotates in the second rotational direction, it rotates independently of the cam.

As the main body is again rotated in the first rotational direction, the forward bearings again instantly bind between the walls, re-engaging the main body and cam. The main body and cam are fixedly re-engaged in a second fixed relationship with the main body in a second relative position. In addition, the main body and cam re-engage regardless of the amount of rotation of the main body in the second rotational direction. Therefore, the device may be used in very tight spaces where angular or rotational movement of the main body is severely restricted because the bearings re-engage the main body and cam in a second relative position regardless of the amount of rotation of the main body in the second rotational direction.

To loosen the fastener, the pivot member or lever switch is pivoted in the second pivot direction. As the pivot member pivots, the pins or toggles contact and dislodge the forward bearings from the forward narrowing sections of the space. The operation of the device is then similar as that described above only in opposite directions.

The pivot member 90 with tabs 96 (FIG. 2) or grip portion 228 (FIG. 5) or the lever switch 420 (FIG. 11) are examples of switching means for switching the wrench between a right and a left direction of travel.

It is to be understood that the detent ball described above may be a pin, pusher, or similar device. It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment (s) of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A reversible bearing clutch device comprising:

a) a primary body;

b) a secondary body rotatably coupled to the primary body; and c) engaging means coupled between the primary and secondary bodies for (i) fixedly engaging the primary and secondary bodies in a first fixed relationship with the primary body in a first relative position, responsive to rotational movement of the primary body in a first rotational direction, (ii) disengaging the primary and secondary bodies, responsive to an amount of rotational movement of the primary body in a second rotational direction, and (iii) fixedly re-engaging the primary and secondary bodies in a second fixed relationship with the primary body in a second relative position, responsive to rotational movement of the primary body in the first rotational direction and regardless of the amount of rotational movement of the primary body in the second rotational direction;

d) wherein the engagement means comprises:

1) a primary wall formed on the primary body;

2) a secondary wall formed on the secondary body generally opposing the primary wall, wherein the primary and secondary walls form at least two tapering spaces therebetween defining a first space and a second space, the spaces tapering in opposing directions;

3) at least two bearings each disposed in one of the at least two tapering spaces defining a first bearing and a second bearing, the bearings being positioned and dimensioned to cause the first bearing to bind between the primary and secondary walls in the first space as the primary body rotates relative to the secondary body in a first rotational direction, and the second bearing to bind between the primary and secondary walls in the second space as the primary body rotates relative to the secondary body in a second rotational direction;

e) displacement means for selectively displacing one of the bearings to prevent the displaced bearing from binding, such that displacement of the first bearing from the first tapering space allows the primary body to rotate independently with respect to the secondary body in the second rotational direction, and such that displacement of the second bearing from the second tapering space allows the primary body to rotate independently with respect to the secondary body in the first rotational direction; and f) wherein the displacement means comprises:

1) a pivot member pivotally coupled to the primary body; and 2) at least one pin formed on the pivot member and extending between the first bearing and the second bearing to engage and dislodge the bearings, such that pivoting the pivot member in a first pivot direction causes the pin to contact and dislodge the second bearing, and such that pivoting the pivot member in a second pivot direction causes the pin to contact and dislodge the first bearing.

2. The device of claim 1, wherein the primary body is elongated; and wherein the secondary body further comprises means for engaging a socket or fastener.

3. The device of claim 1, wherein the engagement means comprises:

a primary wall formed on the primary body;

a secondary wall formed on the secondary body generally opposing the primary wall, wherein the primary and secondary walls form at least two tapering spaces therebetween defining a first space and a second space, the spaces tapering in opposing directions;

at least one bearing disposed in one of the at least two tapering spaces, the bearing being positioned and dimensioned to cause the bearing to bind between the primary and secondary walls in the first space as the primary body rotates relative to the secondary body in a first rotational direction, or to bind between the primary and secondary walls in the second space as the primary body rotates relative to the secondary body in a second rotational direction.

4. The device of claim 3, further comprising:

positioning means for selectively positioning the at least one bearing in either the first or second tapering space, such that positioning the bearing in the second tapering space allows the primary body to rotate independently with respect to the secondary body in the second rotational direction, and such that positioning the bearing in the first tapering space allows the primary body to rotate independently with respect to the secondary body in the first rotational direction.

5. The device of claim 4, wherein the positioning means comprises:

a pivot member pivotally coupled to the primary body;

a recess formed in the pivot member for receiving the at least one bearing; and biasing means for biasing the at least one bearing out of the recess, wherein the bearing is received within the recess as the pivot member pivots between the two tapering spaces, but is biased towards one of the tapering spaces as the recess is pivoted towards one of the tapering spaces, such that pivoting the pivot member is a first pivot direction causes the bearing to be positioned in the first space, and such that pivoting the pivot member in a second pivot direction causes the bearing to be positioned in the second space.

6. The device of claim 1, wherein the primary wall is circular and the secondary wall is non-circular to form the at least two tapering spaces.

7. The device of claim 1, wherein the primary wall is non-circular and the secondary wall is circular to form the at least two tapering spaces.

8. The device of claim 1, wherein the primary and secondary walls are non-circular to form the at least two tapering spaces.

9. The device of claim 1, further comprising:

biasing means for biasing the bearings towards the tapering spaces.

10. The device of claim 1, wherein the displacement means comprises:

a pivot member pivotally coupled to the primary body;

a lever switch pivotally coupled to the primary body, the lever switch having a proximal end for being engaged by a user to pivot the lever switch, the lever switch also having a distal end engaging the pivot member for pivoting the pivot member as the lever switch pivots; and at least one bar formed on the pivot member and extending between the first bearing and the second bearing to engage and dislodge the bearings, such that pivoting the lever switch in a first pivot direction causes the bar to contact and dislodge the second bearing, and such that pivoting the lever switch in a second pivot direction causes the bar to contact and dislodge the first bearing.

11. A wrench device comprising:

a) a primary body having a primary wall;

b) a secondary body rotatably coupled to the primary body and having a secondary wall generally opposing the primary wall, wherein the primary and secondary walls form a space therebetween having a nonuniform width, the secondary body further comprising means for engaging a socket;

c) engaging means disposed in the space formed between the primary and secondary walls for releasably engaging the primary and secondary bodies in a fixed relationship;

d) at least one bearing movably disposed in the nonuniform space between the primary and secondary walls; and e) positioning means for selectively positioning the at least one bearing in the nonuniform space, and having:

1) a pivot member pivotally coupled to the primary body;

2) a recess formed in the pivot member for receiving the at least one bearing; and 3) biasing means for biasing the at least one bearing out of the recess, wherein the bearing is received within the recess as the pivot member pivots.

12. The device of claim 11, wherein the nonuniform space is configured and dimensioned with respect to the engaging means to cause the primary body to rotate independently of the secondary body in one rotational direction and causing the primary and secondary bodies to engage and rotate together in another rotational direction.

13. The device of claim 11, wherein the primary wall is circular and the secondary wall is non-circular to create the nonuniform space.

14. The device of claim 11, wherein the primary wall is non-circular and the secondary wall is circular to create the nonuniform space.

15. The device of claim 11, wherein the primary and secondary walls are non-circular to create the nonuniform space.

16. The device of claim 11, wherein the displacement means comprises:

a pivot member pivotally coupled to the primary body;

a lever switch pivotally coupled to the primary body, the lever switch having a proximal end for being engaged by a user to pivot the lever switch, the lever switch also having a distal end engaging the pivot member for pivoting the pivot member as the lever switch pivots; and at least one bar formed on the pivot member and extending between the bearings to engage and dislodge the bearings, such that pivoting the lever switch in a first pivot direction causes the bar to contact and dislodge one of the bearings, and such that pivoting the lever switch in a second pivot direction causes the bar to contact and dislodge another of the bearings.

17. A wrench device comprising:

a) a primary body;

b) a secondary body rotatably coupled to the primary body and having a means for engaging a socket;

c) at least two bearings disposed between the primary and secondary bodies, the bearings being positioned and dimensioned to cause one of the bearings to bind between the primary and secondary bodies as the primary body rotates relative to the secondary body in a first rotational direction, and another of the bearings to bind between the primary and secondary bodies as the primary body rotates relative to the secondary body in a second rotational direction;

d) wherein the primary and secondary bodies form a space therebetween having a nonuniform width in which the at least two bearings are disposed;

e) biasing means for biasing each of the bearings towards a narrowing section of the nonuniform space; and f) wherein the displacement means comprises:

1) a pivot member pivotally coupled to the main body, the pivot member having a grip means for being gripped by a user to pivot the pivot member; and 2) at least one pin formed on the pivot member and extending into the cavity of the main body between the forward bearing and the reverse bearing to engage and dislodge the bearings, such that pivoting the pivot member in a first pivot direction causes the pin to contact and dislodge the reverse bearing from the reverse end, to thereby permit the main body to rotate independently with respect to the engagement cam and drive member in the second rotational direction, and such that pivoting the pivot member in a second pivot direction causes the pin to contact and dislodge the forward bearing from the forward section, to thereby permit the main body to rotate independently with respect to the engagement cam and drive member the first rotational direction.

18. The device of claim 17, wherein the primary body has a primary wall which is circular and the secondary body has a secondary wall which is non-circular to create the nonuniform space.

19. The device of claim 17, wherein the primary body has a primary wall which is non-circular and the secondary body has a secondary wall which is circular to create the nonuniform space.

20. The device of claim 17, wherein the primary body has a primary wall and the secondary body has a secondary wall, both of which are non-circular to create the nonuniform space.

21. A wrench device comprising:

a) a main body having a cavity formed therein, the cavity being defined by a cavity wall;

b) an engagement cam rotatably disposed in the cavity of the main body and having a means for engaging a socket, the cam further including a cam wall generally opposing the cavity wall, wherein the cavity and cam walls define at least one nonuniform space formed therebetween, the space having opposing narrowing sections defining a reverse section and a forward section;

c) at least two engagement bearings disposed in the at least one space between the cavity wall and the cam wall including a forward bearing being disposed closer to the forward section than the reverse section and a reverse bearing being disposed closer to the reverse section than the forward section;

d) biasing means disposed in the space for biasing the bearings towards the narrowing ends of the space;

e) displacement means coupled to the main body for selectively displacing one of the at least two engagement bearings out of one of the narrowing sections, thus preventing one of the at least two bearings from binding, to thereby permit the main body to rotate independently with respect to the engagement cam and drive member in one rotational direction while one of the at least two bearings is displaced out of one of the narrowing sections; and f) wherein the displacement means comprises:

1) a pivot member pivotally coupled to the main body, the pivot member having a grip means for being gripped by a user to pivot the pivot member; and 2) at least two pins formed on the pivot member defining a forward pin and a reverse pin, the pins extending into the cavity of the main body to engage and dislodge the bearings, such that pivoting the pivot member in a first pivot direction causes the reverse pin to contact and dislodge the reverse bearing from the reverse section, to thereby permit the main body to rotate independently with respect to the engagement cam and drive member in the second rotational direction, and such that pivoting the pivot member in a second pivot direction causes the forward pin to contact and dislodge the forward bearing from the forward section, to thereby permit the main body to rotate independently with respect to the engagement cam and drive member in the first rotational direction.

22. The device of claim 21, wherein the forward bearing is positioned and dimensioned to bind between the cavity wall and the cam wall as the main body rotates with respect to the engagement cam in a first rotational direction, to thereby cause the engagement cam and drive member to engage and rotate with the main body, and wherein the reverse bearing is positioned and dimensioned to bind between the cavity wall and the cam wall as the main body rotates with respect to the engagement cam in a second rotational direction, to thereby cause the engagement cam and drive member to engage and rotate with the main body.

23. The device of claim 21, wherein the main body is elongated and has a proximal end and a distal end, the proximal end having a handle formed thereon for a user to grip, the distal end defining a head for engaging and driving a fastener; and further comprising a drive member disposed on the engagement cam for engaging a socket or fastener.

24. A wrench device, comprising:

a) a primary and secondary body rotatably coupled theretogether, and forming a nonuniform space therebetween;

b) switching means for switching the wrench between a right and a left direction of rotation;

c) a first and second bearing, movably disposed in the nonuniform space;

d) a spring, positioned between the first and second bearings, having a first and second end abutting the first and second bearings respectively; and e) positioning means for selectively positioning the first and second bearings in a binding and non-binding location respectively in the nonuniform space.

25. The device of claim 24, wherein the nonuniform space is configured and dimensioned to cause the primary body to rotate independently of the secondary body in one rotational direction and causing the primary and secondary bodies to engage and rotate together in another rotational direction.

26. The device of claim 25, wherein the primary body has a primary wall that is circular and the secondary body has a secondary wall that is non-circular to create the nonuniform space.

27. The device of claim 25, wherein the primary body has a primary wall that is non-circular and the secondary body has a secondary wall is circular to create the nonuniform space.

28. The device of claim 25, wherein the primary and secondary bodies have a primary and secondary wall respectively that are non-circular to create the nonuniform space.

29. A reversible bearing clutch device, comprising:

a) a primary and secondary body rotatably coupled theretogether forming a nonuniform cavity therebetween;

b) switching means positioned for releasably engaging the primary and secondary bodies in a fixed relationship;

c) a first and second bearing, movably disposed in the nonuniform space;

d) a spring, positioned between the first and second bearings, having a first and second end abutting the first and second bearings respectively; and e) a displacement device, having a pivot member pivotally coupled to the primary body, and at least one pin formed on the pivot member and extending between a first and second bearing to engage and dislodge the bearings, such that pivoting the pivot member in a first and second pivot direction causes the pin to contact and dislodge the second and first bearings respectively.

30. The reversible bearing clutch of claim 29, wherein the displacement device is shaped and positioned to selectively displace one of the bearings to prevent the displaced bearing from binding, such that displacement of the first bearing from the first tapering space allows the primary body to rotate independently with respect to the secondary body in the second rotational direction, and such that displacement of the second bearing from the second tapering space allows the primary body to rotate independently with respect to the secondary body in the first rotational direction.

31. The device of claim 29, wherein the switching means comprises:

a primary wall formed on the primary body;

a secondary wall formed on the secondary body generally opposing the primary wall, wherein the primary and secondary walls form at least two tapering spaces therebetween defining a first space and a second space, the spaces tapering in opposing directions;

the first and second bearings each being disposed in one of the at least two tapering spaces, the bearings being positioned and dimensioned to cause the first bearing to bind between the primary and secondary walls in the first space as the primary body rotates relative to the secondary body in a first rotational direction, and the second bearing to bind between the primary and secondary walls in the second space as the primary body rotates relative to the secondary body in a second rotational direction.

32. A reversible bearing clutch device comprising:

a) a primary body;

b) a secondary body rotatably coupled to the primary body;

c) engaging means coupled between the primary and secondary bodies for (i) fixedly engaging the primary and secondary bodies in a first fixed relationship with the primary body in a first relative position, responsive to rotational movement of the primary body in a first rotational direction, (ii) disengaging the primary and secondary bodies, responsive to an amount of rotational movement of the primary body in a second rotational direction, and (iii) fixedly re-engaging the primary and secondary bodies in a second fixed relationship with the primary body in a second relative position, responsive to rotational movement of the primary body in the first rotational direction and regardless of the amount of rotational movement of the primary body in the second rotational direction;

d) wherein the engagement means comprises:

1) a primary wall formed on the primary body;

2) a secondary wall formed on the secondary body generally opposing the primary wall, wherein the primary and secondary walls form at least two tapering spaces therebetween defining a first space and a second space, the spaces tapering in opposing directions;

3) at least two bearings each disposed in one of the at least two tapering spaces defining a first bearing and a second bearing, the bearings being positioned and dimensioned to cause the first bearing to bind between the primary and secondary walls in the first space as the primary body rotates relative to the secondary body in a first rotational direction, and the second bearing to bind between the primary and secondary walls in the second space as the primary body rotates relative to the secondary body in a second rotational direction;

e) displacement means for selectively displacing one of the bearings to prevent the displaced bearing from binding, such that displacement of the first bearing from the first tapering space allows the primary body to rotate independently with respect to the secondary body in the second rotational direction, and such that displacement of the second bearing from the second tapering space allows the primary body to rotate independently with respect to the secondary body in the first rotational direction; and f) wherein the displacement means comprises:

1) at least one toggle pivotally coupled to the secondary body to engage and dislodge the bearings, the toggle having a head formed on one end for engaging the bearings;

2) a pivot member pivotally coupled to the primary body, the pivot member having a grip means for being gripped by a user to pivot the pivot member; and 3) a cam member formed on the pivot member for engaging the toggle, such that pivoting the pivot member in a first pivot direction causes the toggle to contact and dislodge the second bearing, and such that pivoting the pivot member in a second pivot direction causes the toggle to contact and dislodge the first bearing.

33. The device of claim 32, wherein the at least one toggle comprises:

a) a swivel link pivotally coupled to the secondary body; and b) a pusher member pivotally disposed on the end of the swivel link for engaging and dislodging the bearings.

34. A wrench device comprising:

a) a primary body having a primary wall;

b) a secondary body rotatably coupled to the primary body and having a secondary wall generally opposing the primary wall, wherein the primary and secondary walls form a space therebetween having a nonuniform width, the secondary body further comprising means for engaging a socket;

c) at least two bearings movably disposed in the nonuniform space between the primary and secondary walls defining a first bearing and a second bearing for binding between the primary and secondary bodies;

d) displacement means for selectively displacing one of the bearings, such that displacing one of the bearings allows the primary body to rotate independently with respect to the secondary body in one rotational direction while another of the bearings binds in the nonuniform space causing the primary and secondary bodies to engage and rotate together in another rotational direction; and e) wherein the displacement means comprises:

1) a pivot member pivotally coupled to the primary body;

2) a lever switch pivotally coupled to the primary body, the lever switch having a proximal end for being engaged by a user to pivot the lever switch, the lever switch also having a distal end engaging the pivot member for pivoting the pivot member as the lever switch pivots; and 3) at least one bar formed on the pivot member and extending between the first bearing and the second bearing to engage and dislodge the bearings, such that pivoting the lever switch in a first pivot direction causes the bar to contact and dislodge the second bearing, and such that pivoting the lever switch in a second pivot direction causes the bar to contact and dislodge the first bearing.

35. A wrench device comprising:

a) a primary body having a primary wall;

b) a secondary body rotatably coupled to the primary body and having a secondary wall generally opposing the primary wall, wherein the primary and secondary walls form a space therebetween having a nonuniform width, the secondary body further comprising means for engaging a socket;

c) at least two bearings movably disposed in the nonuniform space between the primary and secondary walls defining a first bearing and a second bearing for binding between the primary and secondary bodies;

d) displacement means for selectively displacing one of the bearings, such that displacing one of the bearings allows the primary body to rotate independently with respect to the secondary body in one rotational direction while another of the bearings binds in the nonuniform space causing the primary and secondary bodies to engage and rotate together in another rotational direction; and e) wherein the displacement means comprises:

1) a pivot member pivotally coupled to the primary body; and 2) at least one pin formed on the pivot member and extending between the first bearing and the second bearing to engage and dislodge the bearings, such that pivoting the pivot member in a first pivot direction causes the pin to contact and dislodge the second bearing, and such that pivoting the pivot member in a second pivot direction causes the pin to contact and dislodge the first bearing.

36. A wrench device comprising:

a) a primary body having a primary wall;

b) a secondary body rotatably coupled to the primary body and having a secondary wall generally opposing the primary wall, wherein the primary and secondary walls form a space therebetween having a nonuniform width, the secondary body further comprising means for engaging a socket;

c) at least two bearings movably disposed in the nonuniform space between the primary and secondary walls defining a first bearing and a second bearing for binding between the primary and secondary bodies;

d) displacement means for selectively displacing one of the bearings, such that displacing one of the bearings allows the primary body to rotate independently with respect to the secondary body in one rotational direction while another of the bearings binds in the nonuniform space causing the primary and secondary bodies to engage and rotate together in another rotational direction; and e) wherein the displacement means comprises:

1) at least one toggle pivotally coupled to the secondary body to engage and dislodge the bearings, the toggle having a head formed on one end for engaging the bearings;

2) a pivot member pivotally coupled to the primary body, the pivot member having a grip means for being gripped by a user to pivot the pivot member; and 3) a cam member formed on the pivot member for engaging the toggle, such that pivoting the pivot member in a first pivot direction causes the toggle to contact and dislodge the second bearing, and such that pivoting the pivot member in a second pivot direction causes the toggle to contact and dislodge the first bearing.

37. A wrench device comprising:

a) a primary body having a primary wall;

b) a secondary body rotatably coupled to the primary body and having a secondary wall generally opposing the primary wall, wherein the primary and secondary walls form a space therebetween having a nonuniform width, the secondary body further comprising means for engaging a socket;

c) at least two bearings movably disposed in the nonuniform space between the primary and secondary walls defining a first bearing and a second bearing for binding between the primary and secondary bodies;

d) biasing means for biasing each of the bearings toward a narrowing section of the nonuniform space;

e) displacement means for selectively displacing one of the bearings to prevent the displaced bearing from binding, such that displacement of one of the bearings allows the primary body to rotate independently with respect to the secondary body in the second rotational direction, and such that displacement of another of the bearings allows the primary body to rotate independently with respect to the secondary body in the first rotational direction; and f) wherein the displacement means comprises:

1) a pivot member pivotally coupled to the primary body; and 2) at least one pin formed on the pivot member and extending between the bearings to engage and dislodge the bearings, such that pivoting the pivot member in a first pivot direction causes the pin to contact and dislodge one of the bearings, and such that pivoting the pivot member in a second pivot direction causes the pin to contact and dislodge another of the bearings.

38. A wrench device comprising:

a) a primary body having a primary wall;

b) a secondary body rotatably coupled to the primary body and having a secondary wall generally opposing the primary wall, wherein the primary and secondary walls form a space therebetween having a nonuniform width, the secondary body further comprising means for engaging a socket;

c) at least two bearings movably disposed in the nonuniform space between the primary and secondary walls defining a first bearing and a second bearing for binding between the primary and secondary bodies;

d) biasing means for biasing each of the bearings toward a narrowing section of the nonuniform space;

e) displacement means for selectively displacing one of the bearings to prevent the displaced bearing from binding, such that displacement of one of the bearings allows the primary body to rotate independently with respect to the secondary body in the second rotational direction, and such that displacement of another of the bearings allows the primary body to rotate independently with respect to the secondary body in the first rotational direction; and f) wherein the displacement means comprises:

1) at least one toggle pivotally coupled to the secondary body to engage and dislodge the bearings, the toggle having a head formed on one end for engaging the bearings;

2) a pivot member pivotally coupled to the primary body, the pivot member having a grip means for being gripped by a user to pivot the pivot member; and 3) a cam member formed on the pivot member for engaging the toggle, such that pivoting the pivot member in a first pivot direction causes the toggle to contact and dislodge one of the bearings, and such that pivoting the pivot member in a second pivot direction causes the toggle to contact and dislodge another of the bearings.

39. The device of claim 38, wherein the at least one toggle comprises:

a) a swivel link pivotally coupled to the secondary body; and b) a pusher member pivotally disposed on the end of the swivel link for engaging and dislodging the bearings.

40. A wrench device comprising:

a) a main body having a cavity formed therein, the cavity being defined by a cavity wall;

b) an engagement cam rotatably disposed in the cavity of the main body and having a means for engaging a socket, the cam further including a cam wall generally opposing the cavity wall, wherein the cavity and cam walls define at least one nonuniform space formed therebetween, the space having opposing narrowing sections defining a reverse section and a forward section;

c) at least two engagement bearings disposed in the at least one space between the cavity wall and the cam wall including a forward bearing being disposed closer to the forward section than the reverse section and a reverse bearing being disposed closer to the reverse section than the forward section;

d) biasing means disposed in the space for biasing the bearings towards the narrowing ends of the space;

e) displacement means coupled to the main body for selectively displacing one of the at least two engagement bearings out of one of the narrowing sections, thus preventing one of the at least two bearings from binding, to thereby permit the main body to rotate independently with respect to the engagement cam and drive member in one rotational direction while one of the at least two bearings is displaced out of one of the narrowing sections; and f) wherein the displacement means comprises:

1) a longitudinal hole formed in the engagement cam;

2) at least one radial bore formed in the engagement cam and extending radially from the longitudinal hole;

3) at least one toggle disposed in the radial bore to engage and dislodge the bearings, the toggle having a head formed on one end for engaging the bearings;

4) a pivot member pivotally coupled to the main body, the pivot member having a grip means for being gripped by a user to pivot the pivot member; and 5) a cam member extending from the pivot member into the longitudinal hole of the engagement cam, the cam member having at least one indentation for engaging the toggle, such that pivoting the pivot member in a first pivot direction causes the toggle to contact and dislodge the reverse bearing from the reverse end, to thereby permit the main body to rotate independently with respect to the engagement cam and drive member in the second rotational direction, and such that pivoting the pivot member in a second pivot direction causes the toggle to contact and dislodge the forward bearing from the forward end, to thereby permit the main body to rotate independently with respect to the engagement cam and drive member in the first rotational direction.

41. The device of claim 40, wherein the at least one toggle comprises:

a swivel link pivotally disposed in the radial bore of the engagement cam and having a proximal end and a distal end, the proximal end engaging the indentation of the cam portion of the pivot member; and a pusher member pivotally disposed on the distal end of the swivel link for engaging and dislodging the bearings.

42. A wrench device comprising:

a) a main body having a cavity formed therein, the cavity being defined by a cavity wall;

b) an engagement cam rotatably disposed in the cavity of the main body and having a means for engaging a socket, the cam further including a cam wall generally opposing the cavity wall, wherein the cavity and cam walls define at least one nonuniform space formed therebetween, the space having opposing narrowing sections defining a reverse section and a forward section;

c) at least two engagement bearings disposed in the at least one space between the cavity wall and the cam wall including a forward bearing being disposed closer to the forward section than the reverse section and a reverse bearing being disposed closer to the reverse section than the forward section;

d) biasing means disposed in the space for biasing the bearings towards the narrowing ends of the space;

e) displacement means coupled to the main body for selectively displacing one of the at least two engagement bearings out of one of the narrowing sections, thus preventing one of the at least two bearings from binding, to thereby permit the main body to rotate independently with respect to the engagement cam and drive member in one rotational direction while one of the at least two bearings is displaced out of one of the narrowing sections; and f) wherein the displacement means comprises:

1) a longitudinal hole formed in the engagement cam;

2) at least two radial bores formed in the engagement cam and extending from the longitudinal hole;

3) at least two toggles each disposed in one of the radial bores defining a forward toggle and a reverse toggle to engage and dislodge the bearings, the toggles having heads formed on one end for engaging the bearings; and 4) a pivot member pivotally coupled to the main body, the pivot member having a grip means for being gripped by a user to pivot the pivot member, the pivot member having a cam portion extending into the longitudinal hole of the engagement cam, the cam portion of the pivot member having at least two indentations for engaging the toggles, such that pivoting the pivot member in a first pivot direction causes the reverse toggle to contact and dislodge the reverse bearing from the reverse end, to thereby permit the main body to rotate independently with respect to the engagement cam and drive member in the second rotational direction, and such that pivoting the pivot member in a second pivot direction causes the forward toggle to contact and dislodge the forward bearing from the forward end, to thereby permit the main body to rotate independently with respect to the engagement cam and drive member in the first rotational direction.

43. The device of claim 42, wherein the at least two toggles each comprise:

a) a swivel link pivotally disposed in the radial bore of the engagement cam and having a proximal end and a distal end, the proximal end engaging the indentation of the cam portion of the pivot member; and b) a pusher member pivotally disposed on the distal end of the swivel link for engaging and dislodging the bearings.

44. A wrench device comprising:

a) a main body having a cavity formed therein, the cavity being defined by a cavity wall;

b) an engagement cam rotatably disposed in the cavity of the main body and having a means for engaging a socket, the cam further including a cam wall generally opposing the cavity wall, wherein the cavity and cam walls define at least one nonuniform space formed therebetween, the space having opposing narrowing sections defining a reverse section and a forward section;

c) at least two engagement bearings disposed in the at least one space between the cavity wall and the cam wall including a forward bearing being disposed closer to the forward section than the reverse section and a reverse bearing being disposed closer to the reverse section than the forward section;

d) biasing means disposed in the space for biasing the bearings towards the narrowing ends of the space;

e) displacement means coupled to the main body for selectively displacing one of the at least two engagement bearings out of one of the narrowing sections, thus preventing one of the at least two bearings from binding, to thereby permit the main body to rotate independently with respect to the engagement cam and drive member in one rotational direction while one of the at least two bearings is displaced out of one of the narrowing sections; and f) wherein the displacement means comprises:

1) a pivot member pivotally coupled to the main body;

2) a lever switch pivotally coupled to the main body, the lever switch having a proximal end for being engaged by a user to pivot the lever switch, the lever switch also having a distal end engaging the pivot member for pivoting the pivot member as the lever switch pivots; and 3) at least one bar formed on the pivot member and extending into the cavity of the main body between the forward bearing and the reverse bearing to engage and dislodge the bearings, such that pivoting the lever switch in a first pivot direction causes the bar to contact and dislodge the reverse bearing from the reverse end, to thereby permit the main body to rotate independently with respect to the engagement cam and drive member in the second rotational direction, and such that pivoting the lever switch in a second pivot direction causes the bar to contact and dislodge the forward bearing from the forward end, to thereby permit the main body to rotate independently with respect to the engagement cam and drive member the first rotational direction.

45. The device of claim 44, further comprising:

a) a protrusion formed on the pivot member and extending radially outwardly, the protrusion having an indentation formed therein; and b) a pin formed on the distal end of the lever switch and movably disposed in the indentation of the pivot member.

46. A wrench device comprising:

a) a main body having a cavity formed therein, the cavity being defined by a cavity wall;

b) an engagement cam rotatably disposed in the cavity of the main body and having a means for engaging a socket, the cam further including a cam wall generally opposing the cavity wall, wherein the cavity and cam walls define at least one nonuniform space formed therebetween, the space having opposing narrowing sections defining a reverse section and a forward section;

c) at least two engagement bearings disposed in the at least one space between the cavity wall and the cam wall including a forward bearing being disposed closer to the forward section than the reverse section and a reverse bearing being disposed closer to the reverse section than the forward section;

d) biasing means disposed in the space for biasing the bearings towards the narrowing ends of the space;

e) displacement means coupled to the main body for selectively displacing one of the at least two engagement bearings out of one of the narrowing sections, thus preventing one of the at least two bearings from binding, to thereby permit the main body to rotate independently with respect to the engagement cam and drive member in one rotational direction while one of the at least two bearings is displaced out of one of the narrowing sections; and f) wherein the displacement means comprises:

1) a pivot member pivotally coupled to the main body;

2) a lever switch pivotally coupled to the main body, the lever switch having a proximal end for being engaged by a user to pivot the lever switch, the lever switch also having a distal end engaging the pivot member for pivoting the pivot member as the lever switch pivots; and 3) at least two bars formed on the pivot member defining a forward bar and a reverse bar, the bars extending into the cavity of the main body to engage and dislodge the bearings, such that pivoting the lever switch in a first pivot direction causes the reverse bar to contact and dislodge the reverse bearing from the reverse, to thereby permit the main body to rotate independently with respect to the engagement cam and drive member in the second rotational direction, and such that pivoting the lever switch in a second pivot direction causes the forward bar to contact and dislodge the forward bearing from the forward end, to thereby permit the main body to rotate independently with respect to the engagement cam and drive member in the first rotational direction.

47. The device of claim 46, further comprising:

a) a protrusion formed on the pivot member and extending radially outwardly, the protrusion having an indentation formed therein; and b) a pin formed on the distal end of the lever switch and movably disposed in the indentation of the pivot member.

* * * * *